US005972553A

United States Patent [19]

Katada et al.

[11] Patent Number: 5,972,553

[45] **Date of Patent: *Oct. 26, 1999**

[54] TONER FOR DEVELOPING ELECTROSTATIC IMAGE, PROCESS-CARTRIDGE AND IMAGE FORMING METHOD

[75] Inventors: Masaichiro Katada; Takashige Kasuya, both of Sohka; Takakuni Kobori, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/736,937

[22] Filed: Oct. 25, 1996

[30] Foreign Application Priority Data

| | | | |
|---|---|---|---|
| Oct. 30, 1995 | [JP] | Japan | 7-303311 |
| Oct. 30, 1995 | [JP] | Japan | 7-303386 |
| Jul. 26, 1996 | [JP] | Japan | 8-214091 |

[51] Int. Cl.[6] ..... G03G 9/097

[52] U.S. Cl. ..... 430/110; 430/109; 430/124

[58] Field of Search ..... 430/110, 109, 430/97, 124, 125

[56] References Cited

U.S. PATENT DOCUMENTS

| | | | |
|---|---|---|---|
| 2,297,691 | 10/1942 | Carlson . | |
| 3,666,363 | 5/1972 | Tanaka et al. . | |
| 4,071,361 | 1/1978 | Marushima . | |
| 4,921,771 | 5/1990 | Tomono et al. | 430/110 |
| 5,135,833 | 8/1992 | Matsumaga et al. | 430/110 |
| 5,384,224 | 1/1995 | Tanikawa et al. | 430/110 |
| 5,478,686 | 12/1995 | Kawakami et al. | 430/106.6 |
| 5,736,288 | 4/1998 | Kasuya et al. | 430/106.6 |

FOREIGN PATENT DOCUMENTS

| | | | |
|---|---|---|---|
| 0488413 | 6/1992 | European Pat. Off. | G03G 9/087 |
| 0618511 | 10/1994 | European Pat. Off. | G03G 9/087 |
| 0619527 | 10/1994 | European Pat. Off. | G03G 9/087 |
| 0658816 | 6/1995 | European Pat. Off. | G03G 9/08 |
| 0662641 | 7/1995 | European Pat. Off. | G03G 9/087 |
| 0686882 | 12/1995 | European Pat. Off. | G03G 9/087 |
| 51-014333 | 2/1976 | Japan . | |

(List continued on next page.)

*Primary Examiner*—Christopher D. Rodee

*Attorney, Agent, or Firm*—Fitzpatrick, Cella, Harper & Scinto

[57] ABSTRACT

A toner for developing an electrostatic image is composed from a composition including: polymer components, a colorant, a wax and a charge-controlling agent. The polymer components are characterized by (a) containing substantially no THF (tetrahydrofuran)-insoluble content; (b) containing a THF-soluble content giving a GPC (gel permeation chromatography) chromatogram showing a main peak in a molecular weight region of $3\times10^3$–$3\times10^4$, and a sub-peak or shoulder in a molecular weight region of $1\times10^5$–$3\times10^6$, and (c) including a low-molecular weight polymer component having molecular weights of below $5\times10^4$ on the GPC chromatogram and an acid value $A_{VL}$, and a high-molecular weight polymer component having molecular weights of at least $5\times10^4$ and an acid value $A_{VH}$ satisfying $A_{VL}>A_{VH}$. The wax has an acid value $A_{VWax}$ satisfying $A_{VL}>A_{VWax}$ and $A_{VWax}>0$ (mgKOH/g). The toner is characterized by a good combination of low-temperature fixability and anti-offset characteristic, a stable chargeability, and freeness from sleeve ghost phenomenon.

41 Claims, 6 Drawing Sheets

FOREIGN PATENT DOCUMENTS

| | | | |
|---|---|---|---|
| 51-23354 | 7/1976 | Japan | G03G 9/08 |
| 55-6805 | 2/1980 | Japan | F23J 13/02 |
| 56-15470 | 2/1981 | Japan | D06M 11/12 |
| 56-116043 | 9/1981 | Japan | G03G 9/08 |
| 56-154740 | 11/1981 | Japan . | |
| 57-148752 | 9/1982 | Japan | G03G 9/08 |
| 57-178249 | 11/1982 | Japan | G03G 9/08 |
| 57-178250 | 11/1982 | Japan | G03G 9/08 |
| 57-208559 | 12/1982 | Japan | G03G 9/08 |
| 58-97056 | 6/1983 | Japan | G03G 9/08 |
| 59-121052 | 7/1984 | Japan | G03G 9/08 |
| 59-121053 | 7/1984 | Japan | G03G 9/08 |
| 60-93456 | 5/1985 | Japan | G03G 9/08 |
| 60-93457 | 5/1985 | Japan | G03G 9/08 |
| 60-247250 | 12/1985 | Japan | G03G 9/08 |
| 61-110155 | 5/1986 | Japan | G03G 9/08 |
| 61-110156 | 5/1986 | Japan | G03G 9/08 |
| 62-9256 | 1/1987 | Japan | G01N 21/47 |
| 62-9356 | 1/1987 | Japan . | |
| 62-226160 | 10/1987 | Japan . | |
| 62-226260 | 10/1987 | Japan | G06F 13/38 |
| 63-34550 | 2/1988 | Japan | G03G 9/08 |
| 63-139356 | 6/1988 | Japan | G03G 5/06 |
| 63-214760 | 9/1988 | Japan | G03G 9/08 |
| 63-217362 | 9/1988 | Japan | G03G 9/08 |
| 63-217363 | 9/1988 | Japan | G03G 9/08 |
| 63-217364 | 9/1988 | Japan | G03G 9/08 |
| 63-313182 | 12/1988 | Japan | G03G 15/20 |
| 1-15063 | 3/1989 | Japan | G03G 9/08 |
| 1-112253 | 4/1989 | Japan | G03G 9/08 |
| 1-187582 | 7/1989 | Japan | G03G 15/20 |
| 1-191156 | 8/1989 | Japan | G03G 13/08 |
| 2-168264 | 6/1990 | Japan | G03G 9/087 |
| 2-214156 | 8/1990 | Japan | H01L 27/115 |
| 2-235069 | 9/1990 | Japan | G03G 9/08 |
| 2-284154 | 11/1990 | Japan | G03G 9/08 |
| 2-284156 | 11/1990 | Japan . | |
| 2-284158 | 11/1990 | Japan | G03G 9/083 |
| 3-50559 | 3/1991 | Japan | G03G 9/08 |
| 3-72505 | 3/1991 | Japan | C08F 12/08 |
| 3-181952 | 8/1991 | Japan | G03G 9/083 |
| 4-162048 | 6/1992 | Japan | G03G 9/08 |
| 4-274247 | 9/1992 | Japan | G03G 9/08 |
| 4-299357 | 10/1992 | Japan | G03G 9/08 |
| 4-337737 | 11/1992 | Japan | G03G 9/08 |
| 4-362953 | 12/1992 | Japan | G03G 9/08 |
| 51-173363 | 7/1993 | Japan | G03G 9/087 |
| 51-173366 | 7/1993 | Japan | G03G 9/08 |
| 52-241371 | 9/1993 | Japan . | |
| 06-208244 | 7/1994 | Japan | G03G 9/087 |
| 06-230600 | 8/1994 | Japan | G03G 9/08 |
| 7-281478 | 10/1995 | Japan | G03G 9/08 |

TONER FOR DEVELOPING ELECTROSTATIC IMAGE, PROCESS-CARTRIDGE AND IMAGE FORMING METHOD

FIELD OF THE INVENTION AND RELATED ART

The present invention relates to a toner for developing electrostatic images used in image forming methods, such as electrophotography and electrostatic printing, and also a process cartridge containing the toner and an image forming method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the electrostatic image is developed with a toner, and the resultant toner image is, after being transferred onto a transfer-receiving material such as paper, via an intermediate transfer member or directly, as desired, fixed by heating, pressing, or heating and pressing, or with solvent vapor to obtain a copy or a print. The residual toner on the photosensitive member which is not transferred is cleaned by various methods, and then the above steps are repeated.

In recent years, such electrophotographic image forming apparatus including a copying machine and a printer have been required to satisfy serious requirements regarding a smaller size, a smaller weight, a higher speed and a higher reliability, and accordingly a toner is required to show higher performances. For example, regarding the step of fixing a toner image onto a sheet such as paper, various methods and apparatus have been developed. Among these, the most popular is the hot pressure fixing system using hot rollers. In the heat-fixing system using such hot rollers, a sheet carrying a toner image to be fixed (hereinafter called "fixation sheet") is passed under the hot roller. The surface of a hot roller having a releasability with the toner contacts the toner image surface on the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation, so that the method is very effective in a high-speed electrophotographic copying machine.

However, the above-mentioned hot roller fixation system frequently used heretofore is liable to be accompanied by the following problems:

(1) There is required a so-called waiting time within which image formation is not allowed, until the hot rollers reach a prescribed temperature.

(2) It is necessary to keep the hot rollers at an optimum temperature so as to prevent fixation failure and offsetting of a toner onto the hot rollers caused by a change in hot roller temperature due to passing of recording or transfer-receiving materials or sheets (i.e., fixation sheets) or other external factors. For this purpose, it is necessary to increase the heat capacity of the hot rollers or the heating member, and this requires a large electrical power consumption and also causes a temperature increase in the image forming apparatus.

(3) As the rollers are at a high temperature, the toner and the fixed image on the recording sheets having passed and discharged out of the rollers are cooled slowly to retain a high viscosity for a substantial time, so that the toner is liable to cause offset or winding of the recording sheets about the rollers leading to paper jamming.

Japanese Laid-Open Patent Application (JP-A) 63-313182 has proposed an image forming apparatus exhibiting a short waiting time and a low electric power consumption including a fixing apparatus wherein a toner image on a recording sheet is heated via a moving heat-resistant sheet by a heat-generating member of a low heat capacity energized and heated by pulse current conduction, thereby to fix the toner image onto the recording sheet. Further, JP-A 1-187582 has proposed a fixing apparatus for heating a toner image via a heat-resistant sheet to fix the toner image onto a recording sheet, wherein the heat-resistant sheet has a heat-resistant layer and a release layer or a low-resistivity layer so as to effectively prevent the offset phenomenon.

A toner capable of realizing excellent fixation of toner images onto recording sheets and prevention of offset as well as a short waiting time and a low power consumption, is desired.

Various trials have been conducted with improved binder resins used in toners.

For example, it has been known to improve the viscoelastic properties of a toner by increasing the glass transition temperature (Tg) and molecular weight of the toner binder resin. However, this measure, when used for improving the anti-offset characteristic, is liable to cause a lowering in fixability, thus resulting in a deterioration of fixability at a low temperature (i.e., a low-temperature fixability) as required in high-speed development and economization of energy.

In order to improve the low-temperature fixability, it is generally required to lower the melt-viscosity of the toner and increase the adhesion area thereof onto a fixation sheet, so that the binder resin used preferable shows a lower Tg or a lower molecular weight.

There is a contradiction between the low-temperature fixability and the anti-offset characteristic, so that it is difficult to develop a toner satisfying these properties in combination.

In order to solve the above-mentioned problems, Japanese Patent Publication (JP-B) 51-23354, for example, has proposed a toner comprising a moderately crosslinked vinyl polymer through addition of a crosslinking agent and a molecular weight adjusting agent. JP-B 55-6805 has proposed a toner containing a polymer comprising an $\alpha,\beta$-ethylenically unsaturated monomer and having a broadened molecular weight distribution as represented by a weight-average molecular weight/number-average molecular weight ratio of 3.5–40.

These toners have a broader fixable temperature range between a fixation lower limit temperature (a lowest temperature at which the fixation is possible) and an offset initiation temperature (at which the offset phenomenon begins to occur) compared with a toner comprising a single resin having a narrow molecular weight distribution. These toners however still involve problems in that a toner having a sufficient anti-offset characteristic cannot have a sufficiently low fixing temperature and, on the other hand, a toner produced with much attention to a low-temperature fixability cannot have a sufficient anti-offset characteristic.

Further, JP-A 57-208559 has proposed a toner wherein a polyester resin, which has been considered to have an essentially better low-temperature fixability than a vinyl resin, is crosslinked and combined with an offset-preventing agent. This toner is excellent in both low-temperature fixability and anti-offset characteristic but has a problem regarding its production (i.e., pulverizability of the kneaded product).

JP-A 56-116043 has proposed a toner using a resin which has been obtained by polymerizing a vinyl monomer in the presence of a reactive polyester resin while causing crosslinking, addition and grafting in the polymerization stage to provide a higher molecular weight. The toner is provided with an improved pulverizability but it is still difficult to fully utilize the characteristics of respective resins regarding the low-temperature fixability and anti-offset characteristic.

JP-B 1-15063 has proposed a toner including a blend of a polyester resin and two types of vinyl resins having different gel contents (at least 80% and below 10%). The toner has a good low-temperature fixability but there is room for further improvements in anti-offset characteristic and pulverizability. If the proportion of the vinyl resin having a gel content of at least 80% is increased so as to improve the anti-offset characteristic, the low-temperature fixability is remarkably impaired. Further, it is difficult to obtain a satisfactory pulverizability of the kneaded product during toner production by simply incorporating a vinyl resin having a gel content of below 10%.

There are also proposals for reacting a polymer having a carboxylic acid group and a metal compound to cause a crosslinking in a binder resin (JP-A 57-178249, JP-A 57-178250), and reacting a binder having a vinyl resin monomer and a specific monoester compound as essential constituents and a multi-valent metal compound to cause a crosslinking via the metal (JP-A 61-110155, JP-A 61-110156).

Further, JP-A 63-214760, JP-A 63-217362, JP-A 63-217363 and JP-A 63-217364 have proposed a binder resin having a molecular weight distribution with two separated portions of a low-molecular weight portion and a high-molecular weight portion, a carboxylic acid group contained in the low-molecular weight portion being reacted with a multi-valent metal ion to cause crosslinking. In any method, however, it is difficult to effect the reaction between the binder and the metal compound or uniform dispersion of the metal compound within the binder, so that it has not yet become possible to completely satisfy the properties required of a toner, especially the fixability and the anti-offset characteristic. Moreover, as it is necessary to incorporate a large amount of the metal compound within the binder resin, the metal compound incorporated can show a catalyst function for the binder resin, thus being liable to cause gellation of the binder resin. As a result, it is difficult to determine the conditions for producing a desired toner by incorporating a metal compound and, even if the production conditions are once determined, it is difficult to obtain a satisfactory reproducibility.

As for these toners having an acid portion, it is desired to further improve the toner chargeability (initial charging speed or quick chargeability), environmental characteristic (performance after standing in a high-humidity environment), and image characteristics (fog and density characteristic).

JP-A 2-168264, JP-A 2-235069, JP-A 5-173363, JP-A 5-173366 and JP-A 5-241371 have proposed binder compositions and toners therefrom having improved fixability, non-offset characteristic, image characteristics, anti-blocking characteristic and quick chargeability by controlling the molecular weights, mixing ratio, and acid values and ratio thereof between low-molecular weight components and high-molecular weight components in the binder resin.

These toners are however liable to cause insufficient dispersion of a colorant, such as magnetic iron oxide, a charge-controlling agent and other additives, leading to soiling of the surfaces of developer-carrying members, such as a carrier and a sleeve, causing fog or image density lowering in the resultant images.

JP-A 62-9356 has proposed a toner binder resin composition comprising a blend of two types of vinyl resins having different molecular weights and acid values. However, when such a binder resin is used, it is necessary to enhance the kneading condition so as to improve the mutual solubility and dispersibility of the toner components. As a result, the binder resin is affected by the severance of molecular chains, so that the anti-offset characteristic is liable to be lowered. In case of a degree of kneading not causing the severance of molecular chains, the other additives are liable to be dispersed insufficiently, thus promoting the soiling of the surfaces of the developer-carrying members, such as a carrier and a sleeve and also resulting in difficulties such as fog and scattering regarding the developing performance. These difficulties are noticeable, particularly when a polymer having a weight-average molecular weight of $10^6$ or higher is used.

JP-A 3-72505 has proposed a vinyl-type toner binder resin having a molecular weight of at least $3\times10^5$ formed by using a multi-functional initiator. In case where such a binder resin is used, a satisfactory fixability is obtained to some extent, whereas the developer is liable to cause a lowering in performance after being left at a high temperature in addition to the above difficulties. It has not been clarified as yet why the lowering in performance is caused but it may be assumed that, during the toner formation, only the severance of molecular chains of the binder resin is promoted to reduce the proportion of a resin component having a sufficient molecular weight in the toner composition, thus resulting in a toner which is less heat-resistant.

On the other hand, a low-softening point release agent (or wax), such as polyolefin, has been employed in order to provide a toner having improved low-temperature fixability and anti-offset characteristic.

JP-A 51-14333, JP-A 57-148752, JP-A 58-97056, JP-A 60-247250, JP-A 4-362953 and JP-A 6-230600 have disclosed release agents comprising solid silicone varnish, higher fatty acid waxes, higher alcohol waxes, vegetable-origin natural waxes, such as carnauba wax and rice wax, and montanate ester waxes. However, it is necessary to further improve the low-temperature fixability and anti-offset characteristic, and also the developing performance (chargeability) and continuous image forming characteristic of the toners.

Such a toner containing a low-softening point release agent is generally liable to result in a toner having a lower flowability and thus showing lower developing performance and transferability. Further, the low-softening point is liable to also adversely affect the chargeability, durability and storability of the toner.

In view of these problems, there have been proposed modified waxes obtained through grafting or block copolymerization with various monomers.

JP-A 59-121052 has proposed the use of polyolefins grafted or block-copolymerized with an α-methylenealiphatic monocarboxylic acid ester monomer. JP-A 56-154740, JP-A 59-121053, JP-A 60-93456 and JP-A 63-34550 have proposed the use of polyolefins grafted or block-copolymerized with aromatic vinyl monomers. The tones containing such modified polyolefins are provided with an improved flowability but are accompanied with inferior anti-offset characteristic and have left room for further improvement in developing performance (chargeability) and continuous image forming characteristics.

JP-A 62-226160, JP-A 63-139356, JP-A 3-50559 and JP-A 6-208244 have proposed toners or toner binder resin compositions containing polypropylene modified with carboxylic acid or maleic acid. No relationship is defined between the resin composition and the release agent in the toners, so that it is desired to accomplish the maintenance of a good flowability and a further improvement in hot offset characteristic.

In order to enlarge the fixing region (non-offset region), it has been proposed to incorporate two or more species of release agent in a toner by JP-A 60-93457, JP-A 4-274247, JP-A 4-299357, JP-A 4-337737, JP-A 6-208244 and JP-A 7-281478. No relationship is defined between the release agent and the resin composition in these toners, so that the toners exhibit a problem in uniform dispersion of the release agent in toner particles.

Further, as a recent technical trend in the field of electrophotographic image forming apparatus, such as copying machines and printer, further improvements in high-speed characteristic, environmental stability and high-image quality characteristic, are desired. The use of a toner under a higher speed condition or severer environmental conditions (high temperature—high humidity or low temperature—low humidity) for a long period, is liable to cause toner deterioration leading to defects, such as fog or image density lowering. As for high-image quality, a higher resolution of 400 dpi, 600 dpi or 1200 dpi is being required in contrast with a former requirement of 240 dpi or 300 dpi.

For this reason, the use of a small particle size toner has been proposed. JP-A 1-112253, JP-A 1-191156, JP-A 2-284156, JP-A 2-284158, JP-A 3-181952 and JP-A 4-162048 have proposed the use of toners having a small particle size and a specific particle size distribution.

On the other hand, the requirement for graphic images of a higher quality is also intense. An aspect of a graphic image quality is a uniformity of image density in a solid image.

As a problematic phenomenon in connection with the density uniformity in solid images in the mono-component developing scheme, there has been known a phenomenon called "sleeve ghost" in which a halftone solid print image is accompanied by an after-image of an immediately preceding print image occurring corresponding to the rotation cycle of a toner-carrying member (sleeve).

More specifically, the sleeve ghost phenomenon most frequently occurs in cases where continuous formation of solid white image is followed by formation of a stripe pattern including solid black print stripes and solid white print stripes, followed further by a halftone solid image (ID (image density)=B'), such that the after image of solid white stripes appears in the solid halftone image at parts thereof contiguous to the solid white stripes as image portions having a slightly lower image density ($ID_{A'}<ID_{B'}$), as shown in FIG. 8.

Further, when a fine toner powder layer is formed on the developing sleeve surface, a toner deposited thereon is liable to have an insufficient charge, so that a non-image part is liable to be developed with the toner to cause "fog". In order to solve the sleeve ghost problem, JP-A 2-284154 has proposed a negatively chargeable magnetic toner comprising a combination of negatively chargeable toner particles with positively chargeable resin particles and negatively chargeable hydrophobic silica fine powder. However, the negatively chargeable magnetic toner leaves room for improvement regarding formation of high resolution-high definition images.

SUMMARY OF THE INVENTION

A generic object of the present invention is to provide a toner for developing electrostatic images having solved the above-mentioned problems.

A more specific object of the present invention is to provide a toner having improved low-temperature fixability and anti-offset characteristic, capable of providing high-quality toner images, having a stable chargeability so as to provide images free from fog even in a long period of continuous image formation and having excellent storability for a long period.

Another object of the present invention is to provide a toner comprising toner particles in which the components are evenly dispersed and capable of retaining excellent image forming characteristics similar to those at the initial stage even after a long period of continuous image formation.

A further object of the present invention is to provide a toner capable of satisfying low-temperature fixability and good continuous image forming characteristics in combination even at a high process speed.

Another object of the present invention is to provide a toner causing no or little "sleeve ghost".

A further object of the present invention is to provide a toner capable of providing higher resolution and higher definition images.

A still further object of the present invention is to provide a process cartridge containing a toner as described above.

A further object of the present invention is to provide an image forming method using a toner as described above.

According to the present invention, there is provided a toner for developing an electrostatic image, comprising a composition including: polymer components, a colorant, a wax and a charge-controlling agent;

wherein the polymer components are characterized by (a) containing substantially no THF (tetrahydrofuran)-insoluble content;

(b) containing a THF-soluble content giving a GPC (gel permeation chromatography) chromatogram showing a main peak in a molecular weight region of $3\times10^3$–$3\times10^4$, and a sub-peak or shoulder in a molecular weight region of $1\times10^5$–$3\times10^6$, and (c) including a low-molecular weight polymer component having molecular weights of below $5\times10^4$ on the GPC chromatogram and an acid value $A_{VL}$, and a high-molecular weight polymer component having molecular weights of at least $5\times10^4$ and an acid value $A_{VH}$ satisfying $A_{VL}>A_{VH}$; and the wax has an acid value $A_{VWax}$ satisfying $A_{VL}>A_{VWax}$ and $A_{VWax}>0$ (mgKOH/g).

According to another aspect of the present invention, there is provided a process-cartridge, comprising: an electrostatic image-bearing member, and developing means for developing an electrostatic image formed on the electrostatic image-bearing member with the above-mentioned toner contained therein; the electrostatic image-bearing member and the developing means being integrally assembled to form a cartridge, which is detachably mountable to a main assembly of the image forming apparatus.

According to still another aspect of the present invention, there is provided an image forming method, comprising: forming an electrostatic image on an electrostatic image-bearing member, and developing the electrostatic image with the above-mentioned toner contained in developing means to form a toner image.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
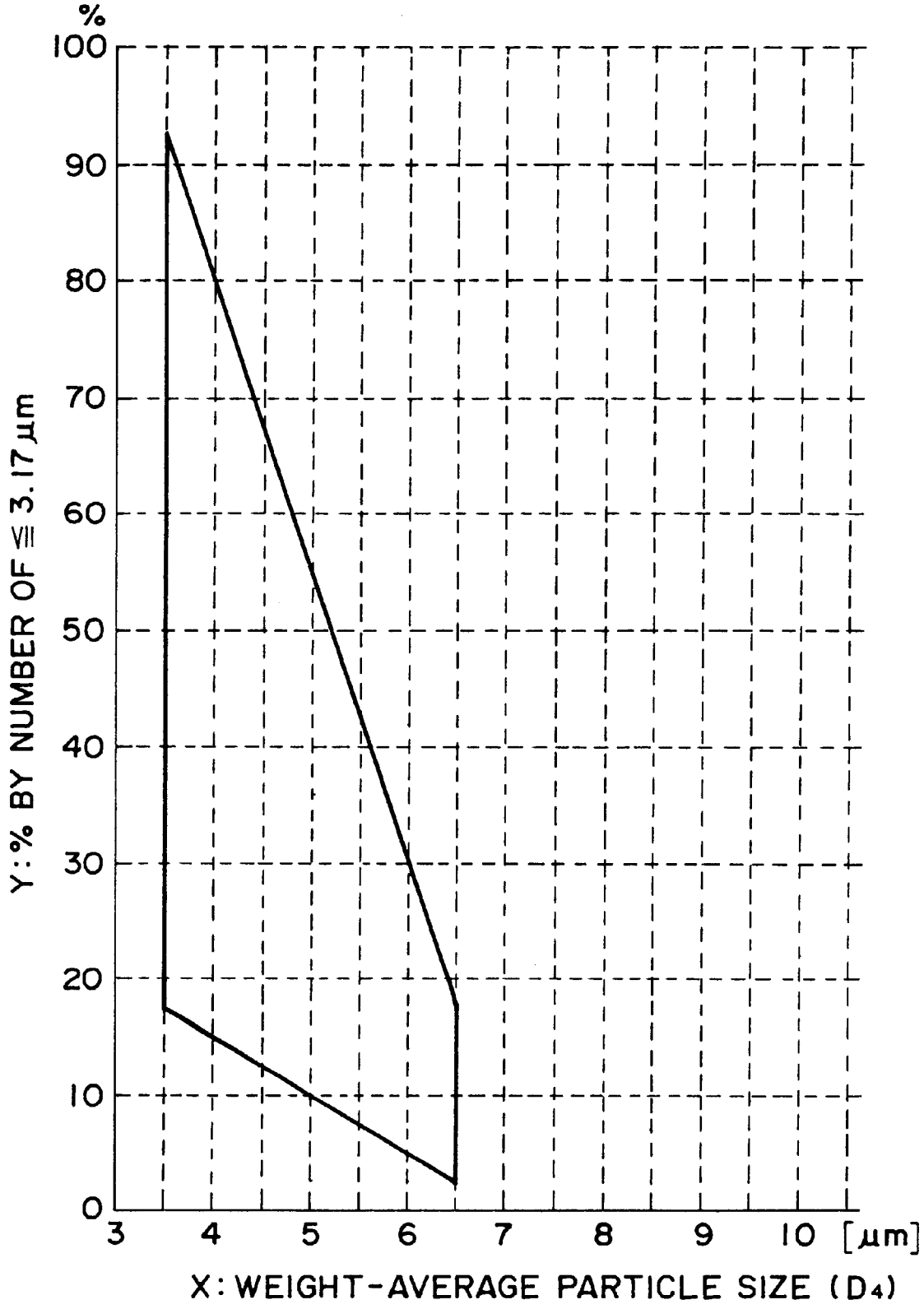
FIG. 1 is a graph showing a particle size distribution range satisfying the conditions of the formulae (1) and (2).

The polymer components in the toner of the present invention are substantially free from THF-insoluble content. More specifically, the polymer components do not contain more than 5 wt. %, preferably more than 3 wt. %, of a THF-insoluble content.

The "THF-insoluble content" referred to herein means a polymer component (substantially, a crosslinked polymer) which is insoluble in a solvent THF (tetrahydrofuran) within a resin composition constituting a toner, and thus may be used as a parameter indicating the degree of crosslinking of a resin composition containing a crosslinked component. The THF-insoluble content may be defined as a value measured in the following manner.

Ca. 0.5–1.0 g of a toner sample is weighed (at $W_1$ g) and placed in a cylindrical filter paper (e.g., "No. 86R" available from Toyo Roshi K.K.) and then subjected to extraction with 100–200 ml of solvent THF in a Soxhlet's extractor. The extraction is performed for 6 hours. The soluble content extracted with the solvent is dried first by evaporation of the solvent and then by vacuum drying at 100° C. for several hours, and weighed (at $W_2$ g). The components other than the resin component, such as a magnetic material and pigment, are weighed or determined (at $W_3$ g). The THF-insoluble content (wt. %) is calculated as $[(W_1-(W_3+W_2))/(W_1-W_3)]\times 100$.

A THF-insoluble content exceeding 5 wt. % results in an inferior low-temperature fixability.

The THF-soluble content of the polymer components in the toner composition according to the present invention has a main peak in a molecular weight region of $3\times10^3$–$3\times10^4$, preferably $5\times10^3$–$2\times10^4$, and a sub-peak or shoulder in a molecular weight region of $1\times10^5$–$3\times10^6$, preferably $5\times10^5$14 $1\times10^6$, respectively on a GPC (gel permeation chromatography) chromatogram thereof.

In the toner of the present invention, it is preferred that the THF-soluble polymer component includes a polymer component having a molecular weight of at least $10^6$ showing an areal proportion of 1–20% more preferably 3–10%, on the above-mentioned GPC chromatogram. By including the THF-soluble component having a molecular weight of at least $10^6$ at 1–20%, it becomes possible to improve the anti-offset characteristic without impairing the low-temperature fixability and also enhance the storage stability under standing at a high temperature.

The molecular weight distribution of polymer components in toners described herein are based on values measured by GPC (gel permeation chromatography) under the following conditions.

[GPC Measurement for Polymer Components in Toner]

Apparatus: GPC-150C (available from Waters Co.)

Columns: 7 columns of KF801–KF807 (all available from Showdex K.K.)

Temperature: 40° C.

Solvent: THF (tetrahydrofuran)

Flow rate: 1.0 ml/min.

Sample concentration: 0.05–0.6 wt. %

Sample volume: 0.1 ml

In the toner according to the present invention, the polymer components include a low-molecular weight polymer component having molecular weights of below $5\times10^4$ on the GPC chromatogram and an acid value $A_{VL}$, and a high-molecular weight polymer component having molecular weights of at least $5\times10^4$ on the GPC chromatogram and an acid value $A_{VH}$ satisfying $A_{VL}>A_{HL}$; and the wax has an acid value $A_{VWax}$ satisfying $A_{VL}>A_{VWax}$, and $A_{VWax}>0$ (mgKOH/g).

As a result of our study, regarding the combination of the polymer components and the wax, it has been found preferable that both have acid values so that the polymer components have acid values satisfying $A_{VL}>A_{VH}$, and the wax has an acid value $A_{VWax}$ satisfying $A_{VWax}<A_{VL}$ relative to the acid value $A_{VL}$ of the low-molecular weight polymer.

More specifically, it has been found that the low-temperature fixability and the anti-offset characteristic of the resultant toner can be remarkably improved by controlling the mutual solubility of the wax with the low-molecular weight polymer in the polymer components.

Regarding the polymer components which have acid values satisfying $A_{VL}>A_{VH}$, the wax having an acid value preferentially reacts with the low-molecular weight polymer component rather than with the high-molecular weight polymer component, and an improved low-temperature fixability can be exhibited due to its plasticizing effect.

Further, it has been also found that the flowability and charging stability of the toner are further stabilized for a long period if the wax has the acid value $A_{VWax}$ satisfying $A_{VWax}<A_{VL}$ relative to the acid value $A_{VL}$ of the low-molecular weight polymer in the polymer components of the toner.

In case where the polymer components have acid values according to $A_{VL}\leqq A_{VH}$, the toner charging stability is lowered, and it becomes difficult to effectively improve the low-temperature stability and anti-offset characteristic even if a wax having an acid value is added.

In the case where the polymer components have acid values satisfying $A_{VL}>A_{HL}$ but the wax has an acid value $A_{VWax}$ giving $A_{VWax}\geqq A_{VL}$, the anti-offset characteristic and the chargeability in a high-humidity environment of the toner are lowered.

It is further preferred that the wax has an acid value $A_{VWax}$ satisfying $0.5xA_{VL}>A_{VWax}>0.05xA_{VL}$ relative to the acid value of the low-molecular weight polymer component.

It is further preferred that the wax satisfies the above-mentioned condition and comprises an acid-modified polyolefin having an acid value of 1–15 mgKOH/g.

It is further preferred that the wax comprises a polyolefin having a molecular terminal modified with at least one acidic monomer selected from maleic acid, maleic acid half ester and maleic anhydride.

It is further preferred that the wax comprises a polypropylene wax having a molecular terminal modified with at least one acidic monomer selected from maleic acid, maleic acid half ester and maleic anhydride.

It is further preferred that the acid component giving the acid-modified wax and the acid component contained in the low-molecular weight polymer component respectively comprise at least one acidic monomer selected from maleic acid, maleic acid half ester and maleic anhydride.

The above-mentioned polypropylene wax preferably used in an acid-modified form may comprise propylene homopolymer or a copolymer of propylene with another olefin (preferably ethylene) preferably containing polymerized propylene units of 60 wt. % or more.

The acid(ic) monomer used for modifying the wax may be similar to one used for adjusting the acid values of the polymer components.

In the present invention, it is preferred that the wax has an acid value $A_{VWax}$ of 1–15 mgKOH/g, the low-molecular weight polymer component has an acid value $A_{VL}$ of 21–35 mgKOH/g, and the high-molecular weight polymer component has an acid value $A_{VH}$ of 0.5–11 mgKOH/g.

The toner according to the present invention may preferably satisfy a particle size distribution including a weight-average particle size $D_4$ of X $\mu$m and Y % by number of toner particles having a particle size of at most 3.17 $\mu$m satisfying the following conditions (1) and (2):

$$-5X+35 \leqq Y \leqq -25X+180 \quad (1)$$

$$3.5 \leqq X \leqq 6.5 \quad (2).$$

The conditions of the formulae (1) and (2) define a region shown in FIG. 1.

The region of particle size distribution defined in FIG. 1 is characterized by a considerably smaller weight-average particle size (X, $D_4$) and a considerably larger amount (Y) of the fine toner fraction compared with commercially available toners used at present. In the present invention, the suppression of "sleeve ghost" is intended to be achieved not by reducing the amount of a fine toner faction which has caused a sleeve ghost phenomenon but by reversely causing the entire toner particle size distribution to approach the region of the fine toner fraction, whereby the chargeability of and the image force acting on the entire toner are caused to approach those of the fine toner fraction so as to provide a special charged toner state of the entire toner particles which has not been hitherto achieved on the toner-carrying member, thereby preventing the selective attachment of a fine toner fraction onto the toner-carrying member and the accompanying fine powder layer formation, leading to the sleeve ghost.

More specifically, in the present invention, as the toner has a specific particle size distribution satisfying the conditions (1) and (2), particularly where the particle size distribution of the entire toner approach that of the fine toner particles having a particle size of 3.17 $\mu$m or below and liable to have a high triboelectric charge, a difference in triboelectric charge based on a particle size difference between the fine toner fraction and the entire toner is reduced, so that the toner particles of a particle size exceeding 3.17 $\mu$m are also adequately attached to the very surface of the developing sleeve and the selective attachment of a fine toner fraction leading to the formation of a fine toner powder layer on the very surface of the developing sleeve is suppressed. As a result, the triboelectric charge of the toner layer formed on the developing sleeve surface may be uniformized to suppress the occurrence of sleeve ghost.

The fixability of the toner having the above-mentioned mentioned particle size distribution is further improved by the above-mentioned combination of the polymer components and the wax component both having acid values, the polymer components having acid values satisfying $A_{VL}>A_{VH}$, and the wax having an acid value $A_{VWax}$ lower than the acid value $A_{VL}$ of the low-molecular weight polymer component.

Even if the toner particle size is reduced, the low-temperature fixability and the anti-offset characteristic are remarkably improved by controlling the mutual solubility between the wax component and particularly the low-molecular weight polymer in the polymer components of the toner.

The toner particle size distribution satisfying the formulae (1) and (2) provides the effects of increase in and uniformity of chargeability but is liable to invite reduced flowability and lower environmental stability. However, by satisfying the GPC molecular weight distribution and the relationship between the wax acid value $A_{VWax}$ and the acid value $A_{VL}$ of the low-molecular weight polymer among the polymer components having specified acid values of $A_{VL}>A_{VWax}$, the dispersibility of components in the toner can be improved to retain a good flowability of the toner. Further, as the quick chargeability of the toner is improved, the chargeability is less liable to be lowered in a high temperature—high humidity environment and the charge can be recovered quickly even if it is lowered. Also in a low temperature—low humidity environment, the charge-up (or excessive change) of the toner can be obviated because of good dispersibility of the respective components in the toner. Accordingly, synergistic effects of providing a toner having enhanced environmental stability and stable performances for a long period can be attained.

Where the amount Y (%) of fine toner fraction ($\leqq$3.17 $\mu$m) is less than −5X+35, the toner-carrying member is liable to be coated with an excessive amount of toner, so that a ripple-like irregularity is liable to occur.

In the case where Y (%) is more than −25X+180, it is difficult to attain the effect of suppressing the formation of a fine toner fraction layer on the toner-carrying member, so that the sleeve ghost is liable to occur.

In the case where the weight-average particle size ($D_4$) X ($\mu$m) is below 3.5 $\mu$m, it becomes difficult to obtain a sufficient image density In the case where X (=$D_4$) $\mu$m is larger than 6.5 $\mu$m, as the particle size of the entire toner is rather remote from that of the fine toner fraction, the effect of suppressing the formation of a fine toner fraction layer on the toner-carrying member is reduced, so that the sleeve ghost is liable to occur.

The toner may preferably have a tap void (void ratio attained after tapping), as obtained from the following formula, in the range of 0.40–0.70:

$$\text{tap void or void ratio} = (\text{true density} - \text{tap density})/\text{true density}.$$

In case where the toner has a tap void below 0.40, it becomes difficult to satisfy the suppression of sleeve ghost and the provision of high image density. Above 0.70, the toner coating layer formed on the toner-carrying member (developing sleeve) becomes nonuniform which results in a lower image uniformity.

The true density of a toner may be measured in the following manner.

1 g of a sample toner is charged in a pelletizer for making a pellet sample for IR measurement and pelletized under a pressure of ca. 1.96 MPa (200 kg.f/cm$^2$). The volume and weight of the resultant sample are measure to obtain a true density.

The tap density of a toner may be measured by using a powder tester ("Powder Tester", available from Hosokawa Micron K.K.) together with an accessory vessel attached to the powder tester along with the procedure stipulated in the instruction manual of the powder tester.

The particle size distribution of a toner may be measured by using a Coulter counter Model TA-II or Coulter Multisizer (available from Coulter Electronics Inc.) together with a 1%-NaCl aqueous solution as an electrolytic solution prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 $\mu$m by using the above-mentioned apparatus with a 100 $\mu$m-aperture to obtain a volume-basis distribution and a number-basis distribution.

The weight-basis average particle size $D_4$ may be obtained from the volume-basis distribution while a central value in each channel is taken as a representative value for each channel. Similarly, the number-basis percentages of particles having particle sizes of at most 5 $\mu$m, at most 3.17 $\mu$m and at most 2.52 $\mu$m may respectively be obtained from the number-basis distribution.

It is further preferred that the polymer components include a low-molecular weight polymer component (occupying a molecular weight region of below $5\times10^4$ on the GPC chromatogram) having an acid value $A_{VL}$ and a high-molecular weight polymer component (occupying a molecular weight region of at most $5\times10^4$) having an acid value $A_{VH}$ satisfying $A_{VL}>A_{VH}$, and the wax component comprises a polyolefin (A) having a weight-average molecular weight ($Mw_{WaxA}$) of $8.0\times10^3$–$1.4\times10^4$ and also having an acid value, and a polyolefin (B) having a weight-average molecular weight ($Mw_{WaxB}$) of $1.0\times10^4$–$4.0\times10^4$, preferably $1.5\times10^4$–$2.5\times10^4$.

As a result of our study, it has been found that, by using a wax comprising two species of waxes having specified molecular weights in combination with the above-mentioned polymer components, the objects of the present invention are better accomplished.

More specifically, the low-temperature fixability and anti-offset characteristic can be remarkably improved by controlling the mutual solubility between the two types of waxes and the high- and low-molecular weight polymers in the polymer components within the toner, respectively.

The molecular weight distribution of wax described herein are based on values measured in the following manner.

[GPC Measurement for Waxes]

Apparatus: GPC-150C (available from Waters Co.)

Column: 2 columns of GMH-HT (available from TOSO K.K.)

Temperature: 135° C.

Solvent: o-dichlorobenzene (containing 0.1% ionol)

Flow rate: 1.0 ml/min.

Sample concentration: 0.15 wt. %

Sample volume: 0.4 ml.

GPC chromatograms are obtained under the above-mentioned conditions, and the molecular weight levels (abscissa) of the chromatogram are determined based on a calibration curve prepared by using mono-disperse polystyrene standard samples. Further, the molecular weights of waxes are calculated as, e.g., polypropylenes, based on a conversion formula derived from a Mark-Houwink viscosity formula.

As the polymer components have acid values satisfying $A_{VL}>A_{VH}$, the polyolefin wax (A) having an acid value and having a lower molecular weight preferentially reacts on the low-molecular weight polymer component rather than on the high-molecular weight polymer component, and an improved plasticizing effect can be exhibited due to its plasticizing effect. Further, the polyolefin wax (B) having a higher molecular weight preferentially react on the high-molecular weight polymer component to exhibit high temperature anti-offset characteristic.

In case where the acid-modified polyolefin wax (A) has a weight-average molecular weight ($Mw_{WaxA}$) of below $8.0\times10^3$ and the polyolefin wax (B) has a weight-average molecular weight ($Mw_{WaxB}$) of below $1.0\times10^4$, difficulties are liable to occur such that the high-temperature anti-offset characteristic is lowered and the balance of mutual solubility with the high- and low-molecular weight polymer components is impaired to lower the dispersibility of the wax within the binder resin (polymer components), thus adversely affecting the developing performance.

In case where the acid-modified polyolefin wax (A) has a weight-average molecular weight exceeding $1.4\times10^4$ and the polyolefin wax (B) has a weight-average molecular weight exceeding $4.0\times10^4$, the low-temperature fixability is liable to be lowered, and the dispersibility in the binder- resin is liable to be lowered.

If the polymer components have acid values $A_{VL}\leqq A_{VH}$, the toner charging stability is lowered, and it becomes difficult to effectively improve the low-temperature fixability and the anti-offset characteristic even if the wax having an acid value is incorporated.

The acid-modified polyolefin wax (A) may preferably have an acid value $A_{VWaxA}$ satisfying:

$$A_{VL}>A_{VWaxA} \text{ and } A_{VWaxA}>0 \text{ (mgKOH/g).}$$

The polymer components having acid values satisfying $A_{VL}>A_{VH}$ can provide a toner having excellent chargeability and it has been found that, if the acid value ($A_{VWaxA}$) of the acid-modified polyolefin wax (A) used in combination with the polymer components satisfies the above-mentioned condition, the flowability and the charging stability can be further stabilized for a long period.

It is further preferred that the acid-modified polyolefin wax (A) in the wax has an acid value ($A_{VWaxA}$) satisfying $0.5xA_{VL}>A_{VWaxA}>0.05xA_{VL}$ relative to the acid value $A_{VL}$ of the low-molecular weight polymer component.

It is further preferred that the acid-modified polyolefin wax (A) satisfies the above-mentioned condition and has an acid value of 1–15 mgKOH/g.

It is further preferred that the the acid-modified polyolefin wax (A) comprises a polypropylene having a molecular terminal modified with at least one acidic monomer selected from maleic acid, maleic acid half ester and maleic anhydride.

It is further preferred that the acid component giving the acid-modified polyolefin wax (A) and the acid component contained in the low-molecular weight polymer component respectively comprise at least one acidic monomer selected from maleic acid, maleic acid half ester and maleic anhydride.

The polyolefin wax (B) preferably comprises polypropylene wax, which may comprise propylene homopolymer or a copolymer of propylene with another olefin (preferably ethylene).

In the present invention, it is preferred that the low-molecular weight polymer component has an acid value $A_{VL}$ of 21–35 mgKOH/g, and the high-molecular weight polymer component has an acid value $A_{VH}$ of 0.5–11 mgKOH/g, while satisfying a relationship therebetween of $10 \leqq (A_{VL}-A_{VH}) \leqq 27$.

The low-temperature fixability is affected by the Tg and molecular weight distribution of the low-molecular weight polymer component. By causing the low-molecular weight polymer component to include an acid component and have an acid value which is larger by at least 10 mgKOH/g than that of the high-molecular weight polymer component, the resultant resin composition can have a lower viscosity than a resin composition having identical Tg and identical molecular weight distribution but having an acid value falling outside the above-mentioned ranges.

This is presumably for the following reason. By setting the acid value (0.5–11 mgKOH/g) of the high-molecular weight polymer component to be lower by at least 10 mgKOH/g than that of the low-molecular weight polymer component, the entanglement of molecular chains between the low- and high-molecular weight polymer components and with those of the wax is suppressed to some extent, so that it becomes possible to lower the viscosity at low temperatures and maintain the elasticity at high temperatures, and the wax is allowed to be present with a certain domain size within the toner particles to exhibit a sufficient release effect. These factors lead to an enhanced low-temperature fixability and an improved developing performance in a high-speed machine.

On the other hand, if the acid value difference exceeds 27 mgKOH/g, the miscibility between the low- and high-molecular weight components and the dispersibility of the wax therein are liable to be impaired, thus resulting in lower anti-offset characteristic and developing performance in continuous image formation.

Further, in case where the low-molecular weight polymer component has an acid value of at least 21 mgKOH/g, the quick chargeability can be improved. On the other hand, if the acid value of the low-molecular weight polymer component exceeds 35 mgKOH/g, the developing performance in a high humidity environment is liable to be lowered.

In case where the high-molecular weight polymer component has an acid value below 0.5 mgKOH/g, the miscibility thereof with the low-molecular weight polymer component (having an acid value of 21–35 mgKOH/g) and the wax can be impaired, thus being liable to provide a lower anti-offset characteristic and causing fog.

The polymer components may preferably have a ratio of acid value/total acid value of at most 0.7, more preferably 0.4–0.6. If the ratio of acid value/total acid value exceeds 0.7, the balance in toner chargeability (i.e., balance between triboelectric charge and discharge) favors an enhanced change, thus being liable to cause a lower charging stability and a charge-up tendency of the toner.

It is preferred that the polymer components (moreo specifically, THF-soluble content thereof) provide a GPC chromatogram showing a minimum in a molecular weight region of from $3\times10^4$ to below $1\times10^5$. In order to provide a combination of low-temperature fixability and high-temperature anti-offset characteristic, it is preferred that the low-molecular weight polymer component and the high-molecular weight polymer component form separate molecular weight distributions.

In the polymer components of the toner, it is preferred that the low- and high-molecular weight polymer components are blended in $W_L$ and $W_H$ wt. parts, respectively, satisfying a ratio $W_L:W_H$=50:50–90:10. This is because the ratio of the low- and high-molecular weight polymer components provides improved fixability and anti-offset characteristic. If the low-molecular weight polymer component is below 50 wt. %, the fixability is lowered. On the other hand, if the high-molecular weight polymer component is below 10 wt. %, the high-temperature anti-offset characteristic is lowered.

Further, it is preferred that the mixing amounts and the acid values satisfy the following relationships:

$$A_{VL}\times W_L/(W_L+W_H) \geqq A_{VH}\times(W_H/(W_L+W_H))\times 4$$

$$11 \leqq (A_{VL}W_L+A_{VH}W_H)/(W_L+W_H) \leqq 30.$$

This is for the following reasons. Non-satisfaction of the upper formula means $A_{VL}\times W_L/(W_L+W_H) < A_{VH}\times(W_H/(W_L+W_H))\times 4$. Thus, the acid value of the low-molecular weight component in the resin composition is below 4 times the acid value of the high-molecular weight component in the resin composition, whereby the miscibility between the low-molecular weight component and the high-molecular weight component is enhanced, so that it becomes difficult to separately exhibit the low viscosity at the low-temperature side and the high viscosity at the high-temperature side.

Further, in case where $(A_{VL}W_L+A_{VH}W_H)/(W_L+W_H)$ is below 11, the quick chargeability can be impaired. On the other hand, where that ratio exceeds 30, the developing performance in a high humidity environment is liable to be lowered.

The acid values (JIS acid value) of low- and high-molecular weight polymer components in a toner referred to herein are based on values measured in the following manner.

Collection of the Respective Components [Apparatus Organization]

LC-908 (mfd. by Nippon Bunseki Kogyo K.K.)

JRS-86 (do.; repeat injector)

JAR-2 (do.; auto-sampler)

FC-201 (mfd. by Gilson Corp.; fraction collector)

[Column Organization]

JAIGEL—1H to 5H (20 mm-dia.×600 mm-L, fraction-collection column)

[Measurement Conditions]

Temperature: 40° C.,

Solvent: THF,

Flow rate: 5 ml/min.,

Detector: R.I.

A sample toner is preliminarily subjected to separation of additives other than polymer components. For the fraction collection, an elution time corresponding to a molecular weight of $5\times10^4$ is measured in advance, and a low-molecular weight polymer component and a high-molecular weight polymer component are recovered before and after the elution time, respectively. The solvent is removed from the recovered (fractionated) samples to provide samples for acid value measurement in the following manners.

Measurement of Acid Value ($A_V$=JIS acid value)

1) 0.1–0.2 g of a sample in a pulverized form is accurately weighed at W (g).

2) The sample is placed in a 20 cc-Erlenmeyer flask, and 10 cc of a toluene/ethanol (=2/1) mixture is added thereto to dissolve the sample.

3) Several drops of phenolphthalein alcohol solution are added as an indicator.

4) The solution in the flask is titrated with a 0.1 normal-KOH alcohol solution added through a buret. The volume of the KOH solution used for the titration is read at S (ml).

Separately, a blank titration is performed to read the KOH solution at this time at B (ml).

5) The acid value ($A_V$) is calculated by the following equation.

Acid value ($A_V$)=(S-B)×f×5.61/W, wherein f denotes the factor of the KOH solution.

Measurement of Total Acid Value ($TA_V$)

1) Ca. 2 g of a sample is accurately weighed at W' (g).

2) The sample is placed in a 200 cc-Erlenmeyer flask, and 30 cc of 1,4-dioxane, 10 cc of pyridine and 20 mg of 4-dimethylaminopyrimidine are added thereto.

3) 3.5 cc of deionized water is added, and the content is refluxed for 4 hours and then cooled.

4) Several drops of phenolphthalein alcohol solution are added as an indicator.

5) The solution in the flask is titrated with a 0.1 normal-KOH solution in THF added through a buret. The volume of the KOH solution used for the titration is read at S' (ml).

Separately, a blank titration is performed to read the KOH solution at this time at B' (ml).

6) The total acid value ($TA_V$) is calculated by the following equation.

Total acid value ($TA_V$)=(S'−B')×f'×5.61/W', wherein f' denotes the factor of the KOH solution.

The above-mentioned KOH solution in THF may be prepared by dissolving 6.6 g of KOH in 20 cc of deionized water and adding 720 cc of THF (tetrahydrofuran) and 100 cc of deionized water, followed by addition of methanol until the system becomes transparent.

Examples of the monomer (carboxyl group-containing monomer) used for adjusting the acid values of the polymer components may include: acrylic acid and α- or β-alkyl derivatives, such as acrylic acid, methacrylic acid, α-ethylacrylic acid, and crotonic acid; and unsaturated dicarboxylic acids, such as fumaric acid, maleic acid and citraconic acid, and mono-ester derivatives thereof. Desired polymers may be synthesized by polymerizing these monomers alone or in mixture, or by copolymerization of these monomers with other monomers. Among these, it is particularly preferred to use mono-ester derivatives of unsaturated dicarboxylic acids in order to control the ratio of acid value/total acid value.

Preferred examples of the acidic or carboxyl group-containing monomer may include: monoesters of α,β-unsaturated dicarboxylic acids, such as monomethyl maleate, monoethyl maleate, monobutyl maleate, monooctyl maleate, monoallyl maleate, monophenyl maleate, monomethyl fumarate, monoethyl fumarate, monobutyl fumarate and monophenyl fumarate; monoesters of alkenyldicarboxylic acids, such as monobutyl n-butenylsuccinate, monomethyl n-octenylsuccinate, monoethyl n-butenylmalonate, monomethyl n-dodecenylglutarate, and monobutyl n-butenyladipate; and monoesters of aromatic dicarboxylic acids, such as monomethyl phthalate, monoethyl phthalate and monobutyl phthalate.

The above-mentioned carboxyl group-containing monomer may preferably constitute 1–20 wt. %, particularly 3–15 wt. %, of the total monomers providing a polymer component of the binder resin.

A dicarboxylic acid monoester is preferred in preparation of a polymer component in an aqueous medium because acid monomer having a high solubility in an aqueous suspension medium is not suitable but an ester having a lower solubility is preferred in suspension polymerization.

The carboxylic acid group and carboxylic acid ester site can be subjected to saponification by an alkaline treatment. It is also preferred to convert the carboxylic acid group and the carboxylic acid ester site into a polar functional group by reaction with an alkaline cationic component. This is because, even if a carboxylic group potentially capable of reacting with a metal-containing organic compound is contained in a polymer component, the crosslinking efficiency thereof is lowered, if the carboxylic acid group is in the form of an anhydride, i.e., cyclized.

The alkaline treatment may be performed by adding an alkali into the solvent medium after the preparation of the binder resin. Examples of the alkali may include: hydroxides of alkaline metal or alkalline earth metals, such as Na, K, Ca, Li, Mg and Ba; hydroxides of transition metals such as Zn, Ag, Pb and Ni; and ammonium hydroxide, alkylammonium hydroxides, such as pyriminium hydroxide. Particularly preferred examples may include NaOH and KOH.

The above-mentioned saponification need not be effected with respect to all the carboxylic acid group and carboxylic ester sites of the copolymer, but a part of the carboxylic groups can be saponified into a polar functional group.

The alkali for the saponification may be used in an amount of 0.02–5 equivalents to the acid value of the binder resin. Below 0.02 equivalent, the saponification is liable to be insufficient to provide insufficient polar functional groups, thus being liable to cause insufficient crosslinking thereafter. On the other hand, in excess of 5 equivalents, the functional group, such as the carboxylic ester site, can be subject to adverse effects, such as hydrolysis and salt formation.

If the alkalline treatment in an amount of 0.02–5 equivalents to the acid value is effected, the remaining cation concentration may be within the range of 5–1000 ppm.

The toner composition may preferably have a glass transition temperature (Tg) of 50–70° C., more preferably 55–65° C. in view of the storability. If Tg is below 50° C., the deterioration in a high temperature environment and offset at the time of fixation of the toner may be caused. If Tg is above 70° C., the fixability is liable to be lowered.

The low-molecular weight polymer component and the high-molecular weight polymer component may preferably have $Tg_L$ and $Tg_H$, respectively, satisfying $Tg_L \geqq Tg_H-5$ (° C.). In case of $Tg_L < Tg_H-5$, the developing performance is liable to be lowered. $Tg_L \geqq Tg_H$ is further preferred.

The binder resin (polymer component mixture) of the toner may be obtained through various processes, inclusive of: a solution blend process wherein a high-molecular weight polymer and a low-molecular weight polymer produced separately are blended in solution, followed by removal of the solvent; a dry blend process wherein the high- and low-molecular weight polymers are melt-kneaded by means of, e.g., an extruder; and a two-step polymerization process wherein a low-molecular weight polymer prepared, e.g., by solution polymerization is dissolved in a monomer constituting a high-molecular weight polymer, and the resultant solution is subjected to suspension polymerization, followed by washing with water and drying to obtain a binder resin. However, the dry blend process leaves a problem regarding the uniform dispersion and mutual solubilities, and the two-step polymerization process makes it difficult to increase the low-molecular weight component in excess of the high-molecular weight component while it is advantageous in providing a uniform dispersion. Further, the two-step polymerization process providing a difficulty that, in the presence of a low-molecular weight polymer component, it is difficult to form an adequately high-molecular weight component and an unnecessary low-molecular weight component is by-produced. Accordingly, the solution blend process is most suitable in the present invention. In order to introduce a prescribed acid value into the low-molecular weight polymer component, the solution polymerization method allowing easy setting of acid value is preferred than the polymerization method in an aqueous medium.

The high-molecular weight component in the binder resin composition used in the present invention may be produced by solution polymerization, emulsion polymerization or suspension polymerization.

In the emulsion polymerization process, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitutes a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer at a high purity. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium. The polymerization temperature may suitably be in the range of 50–95° C. and selected depending on the polymerization initiator used and the objective polymer.

The high-molecular weight polymer component in the resin composition may preferably be produced in the presence of a combination of a polyfunctional polymerization initiator and a monofunctional polymerization initiator, as enumerated hereinbelow.

Specific examples of the polyfunctional polymerization initiator may include: polyfunctional polymerization initiators having at least two functional groups having a polymerization-initiating function, such as peroxide groups, per molecule, inclusive of 1,1-di-t-butylperoxy-3,3,5-trimethylcyclohexane, 1,3-bis-(t-butylperoxyisopropyl) benzene, 2,5-dimethyl-2,5-(t-butylperoxy)hexane, 2,5-dimethyl-2,5-di-(t-butylperoxy)hexane-3, tris(t-butylperoxy)triazine, 1,1-di-t-butylperoxycyclohexane, 2,2-di-t-butylperoxybutane, 4,4-di-t-butylperoxyvalueric acid n-butyl ester, di-t-butylperoxyhexahydroterephthalate, di-t-butylperoxyazelate, di-t-butylperoxytrimethyladipate, 2,2-bis-(4,4-di-t-butylperoxycyclohexyl)propane, 2,2-t-butylperoxyoctane and various polymer oxides; and polyfunctional polymerization initiators having both a polymerization-initiating functional group, such as peroxide group, and a polymerizable unsaturation group in one molecule, such as diallylperoxydicarbonate, t-butylperoxymaleic acid, t-butylperoxyallylcarbonate, and t-butylperoxyisopropylfumarate.

Among these, particularly preferred examples may include: 1,1-di-t-butylperoxy-3,3,5-trimethylcyclohexane, 1,1-di-t-butylperoxycyclohexane, di-t-butylperoxyhexahydroterephthalate, di-t-butylperoxyazelate, 2,2-bis(4,4-di-t-butylperoxycyclohexyl) propane, and t-butylperoxyallylcarbonate.

These polyfunctional polymerization initiators may be used in combination with a monofunctional polymerization initiator, preferably one having a 10 hour-halflife temperature (a temperature providing a halflife of 10 hours by decomposition thereof) which is lower than that of the polyfunctional polymerization initiator, so as to provide a toner binder resin satisfying various requirements in combination.

Examples of the monofunctional polymerization initiator may include: organic peroxides, such as benzoyl peroxide, 1,l-di(t-butylperoxy)-3,3,5-trimethylcyclohexane, n-butyl-4,4-di(t-butylperoxy)valerate, dicumyl peroxide, α,α'-bis(t-butylperoxydiisopropyl)benzene, t-butylperoxycumeine and di-t-butyl peroxide; and azo and diazo compounds, such as azobisisobutyronitrile, and diazoaminoazobenzene.

The monofunctional polymerization initiator can be added to the monomer simultaneously with the above-mentioned polyfunctional polymerization initiator but may preferably be added after lapse of a polymerization time which exceeds the halflife of the polyfunctional polymerization initiator, in order to appropriately retain the initiator efficiency of the polyfunctional polymerization initiator.

The above-mentioned polymerization initiators may preferably be used in an amount of 0.05–2 wt. parts per 100 wt. parts of the monomer in view of the efficiency.

The high-molecular weight polymer component of the resin composition used in the present invention may preferably be crosslinked with a crosslinking monomer as enumerated hereinbelow so as to satisfy the required properties according to the present invention.

The crosslinking monomer may principally be a monomer having two or more polymerizable double bonds. Specific examples thereof may include: aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of 1 wt. part or less, particularly about 0.001–0.05 wt. parts, per 100 wt. parts of the other vinyl monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

On the other hand, the low-molecular weight polymer component within the binder resin, may be produced through a known process. According to the bulk polymerization, however, such a low-molecular weight polymer can be produced by adopting a high polymerization temperature providing an accelerated reaction speed thus the reaction cannot be controlled easily. In contrast thereto, according to the solution polymerization process, such a low-molecular weight polymer can be produced under moderate conditions by utilizing the radical chain transfer function of the solvent and by adjusting the polymerization initiator amount or reaction temperature, so that the solution polymerization process is preferred for formation of the low-molecular weight component in the binder resin. It is also effective to perform the solution polymerization under an elevated pressure, so as to suppress the amount of the polymerization initiator to the minimum and suppress the adverse effect of the residual polymerization initiator.

Examples of the monomer constituting the high-molecular weight polymer component and the low-molecular weight polymer component in the binder resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, diniethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide; the esters of the above-mentioned $\alpha,\beta$-unsaturated acids and the diesters of the above-mentioned dibasic acids. These vinyl monomers may be used singly or in combination of two or more species.

Among these, a combination of monomers providing styrene-polymers or styrene copolymers inclusive of styrene-acrylic type copolymers may be particularly preferred.

It is further preferred that both the low-and high-molecular weight polymer components contain at least 65 wt. % of polymerized styrene units in the form of styrene homopolymer or styrene copolymers in view of miscibility therebetween.

The above-mentioned polypropylene wax may comprise propylene homopolymer or a copolymer of propylene with another olefin (preferably ethylene) preferably containing polymerized propylene units of 60 wt. % or more.

The acid(ic) monomer used for modifying the wax may be similar to one used for adjusting the acid values of the polymer components.

In the present invention, it is also possible to use a release agent or wax having no acid value in addition to the wax having an acid value.

The wax (low-molecular weight wax) used in the present invention may preferably have a weight-average molecular weight of at most $3\times10^4$, more preferably at most $10^4$. The addition amount thereof may preferably be about 1–20 wt. parts per 100 wt. parts of the binder polymer component.

In toner production, the wax can be added to and mixed with the binder resin in advance. It is also possible to preliminarily dissolve the wax and the high-molecular weight polymer in a solvent, and mix the resultant solution with a solution of the low-molecular weight polymer, thereby producing a binder resin.

Such polymer solutions may for example have a solid content of 5–70 wt. % in view of dispersion efficiency, prevention of denaturation of the resin under stirring and operability. More particularly, the preliminary solution of the high-molecular weight polymer component and the wax may for example have a solid content of 5–60 wt. %, and the low-molecular weight polymer solution may for example have a solid content of 5–70 wt. %.

The high-molecular weight polymer component and the wax may be dissolved or dispersed under stirring either batchwise or continuously to prepare the preliminary solution.

The blending with the low-molecular weight polymer solution may be performed by blending the low-molecular weight polymer solution in an amount of 10–1000 wt. parts with the preliminary solution containing 100 wt. parts of the solid content. The blending may be performed either batchwise or in a continuous manner.

Examples of the organic solvent used for the solution blending for preparation of the resin composition may include: hydrocarbon solvents, such as benzene, toluene, xylene, solvent naphtha No. 1, solvent naphtha No. 2, solvent naphtha No. 3, cyclohexane, ethylbenzene, Solvesso 100, Solvesso 150 and mineral sprit; alcohol solvents, such as methanol, ethanol, iso-propyl alcohol, n-butyl alcohol, sec-butyl alcohol, iso-butyl alcohol, amyl alcohol, and cyclohexanol; ketone solvents, such as acetone, methyl ethyl ketone, methyl isobutyl ketone, and cyclohexanone; ester solvents, such as ethyl acetate, n-butyl acetate, and cellosolve acetate; and ether solvents, such as methyl cellosolve, ethyl cellosolve, high cellosolve and methyl carbitol. Among these, aromatic, ketone and/or ester solvents may be preferred. These solvents can be used in mixture.

The organic solvent may preferably be removed by removing 10–80 wt. % thereof by heating the polymer solution under a normal pressure and removing the remainder under a reduced pressure. In this instance, it is preferred to retain the polymer solution at a temperature which is at least the boiling point of the solvent and at most 200° C. Below the boiling point, not only the efficiency of the solvent removal is lowered, but also the polymers within the organic solvent receive an unnecessary shearing force to promote re-distribution of the component polymers, thus being liable to cause microscopic phase separation. In excess of 200° C., the de-polymerization of the polymerization is liable to occur, thus not only resulting in oligomers due to molecular severance but also being liable to result in monomers which may be entrained into the product resin.

It is possible to constitute-the toner according to the present invention as a magnetic toner containing magnetic iron oxide particles.

The magnetic iron oxide particles may preferably be contained in an amount of 20–200 wt. parts, further preferably 30–150 wt. parts, per 100 wt. parts of the binder resin.

As desired, the magnetic iron oxide particles can be treated with silane coupling agent, titanate coupling agent, aminosilanes, organic silicon compounds, etc.

Examples of the silane coupling agent used for surface-treatment of the magnetic iron oxide particles may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilanemercaptan, trimethylsilyl-mercaptan, triorganosilyl acrylate, vinyldimethyl-acetoxysilane, dimethylethoxysilane, dimethyl-dimethoxysilane, diphenyldiethoxysilane, hexamethyldisiloxane, 1,3-divinyltetramethyldisiloxane, and 1,3-diphenyltetramethyldisiloxane.

Examples of the titanate coupling agent may include: isopropoxytitanium triisostearate, isopropoxytitanium dimethacrylate isostearate, isopropoxytitanium tridecylbenzenesulfonate, isopropoxytitanium trisdioctylphosphate, isopropoxytitanium-tri-N-ethylaminoethylaminate, titanium bisdioctylpyrophosphate oxyacetate, titanium bisdioctylphosphate ethylenedioctylphosphite, and di-n-butoxybistriethanolaminatotitanium.

The organic silicon compound may for example be silicone oil. The silicone oil may preferably have a viscosity at 25° C. of about 30–1,000 centi-stokes and may preferably include, for example, dimethylsilicone oil, methylphenylsilicone oil, a-methylstyrene-modified silicone oil, chlorophenylsilicone oil, and fluorinated silicone oil.

The colorant added into the toner according to the present invention may be known ones, inclusive of carbon black, and dyes or pigments, such as copper phthalocyanine.

The toner according to the present invention, as a characteristic thereof, contains a metal-containing organic compound as a charge-controlling agent. In the case of a negatively chargeable toner, it is possible to use a negative charge-controlling agent, such as a metal complex of monoazo dye, or a metal complex of salicylic acid, alkylsalicylic acid, dialkylsalicylic acid or naphthoic acid.

Examples of the negative charge-controlling agent may include metal-containing organic compounds complexes represented by the following formula [I]:

[I]

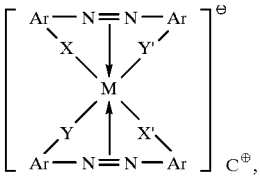

wherein M denotes a coordination center metal, inclusive of metal elements having a coordination number of 6, such as Cr, Co, Ni, Mn and Fe; Ar denotes an aryl group, such as phenyl or naphthyl, capable of having a substituent, examples of which may include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms; and $C^{\oplus}$ denotes hydrogen, sodium, potassium, ammonium or aliphatic ammonium.

Specific examples of the metal-containing organic compounds may include the following:

[I]-1

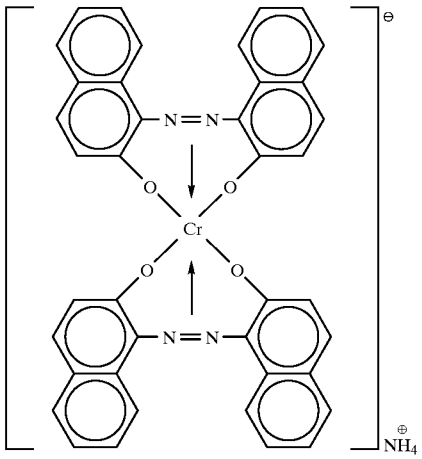

[I]-2

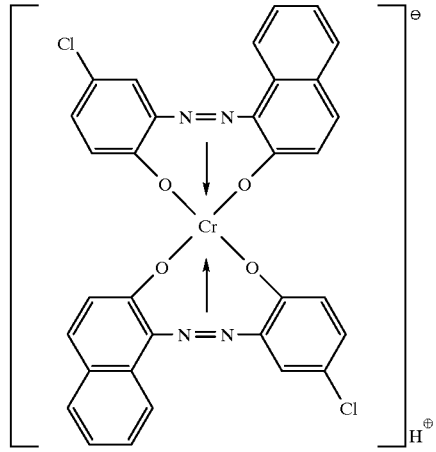

[I]-3

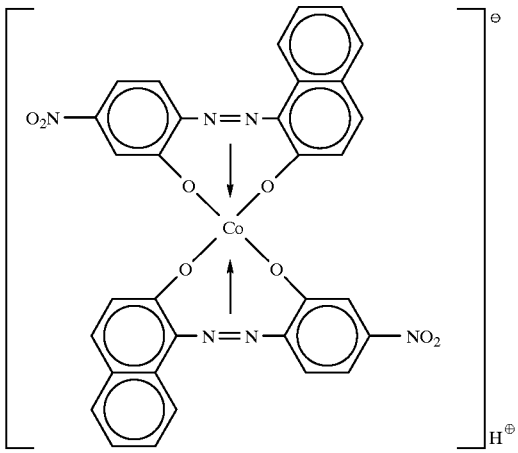

-continued

[I]-4

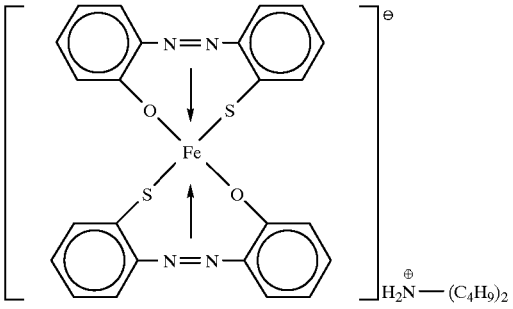

[I]-5

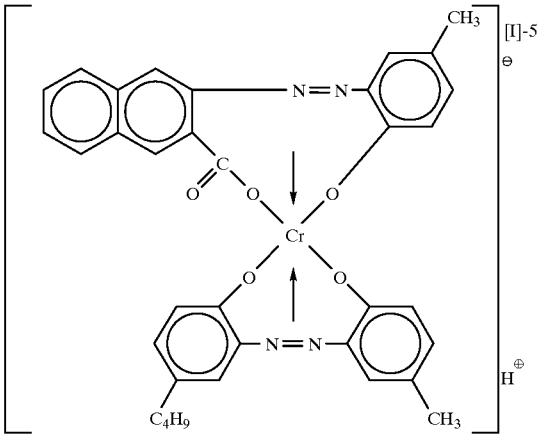

-continued

[I]-6

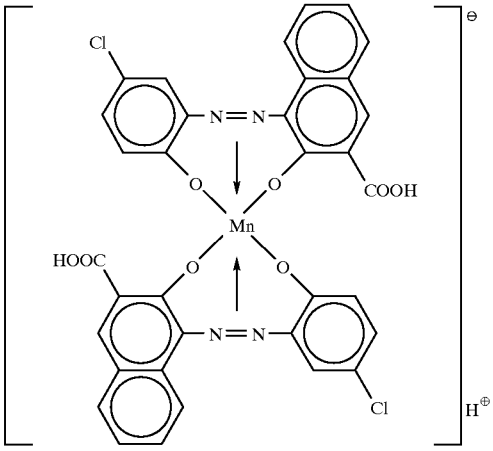

Monoazo iron complexes of the formula:

[I]-7

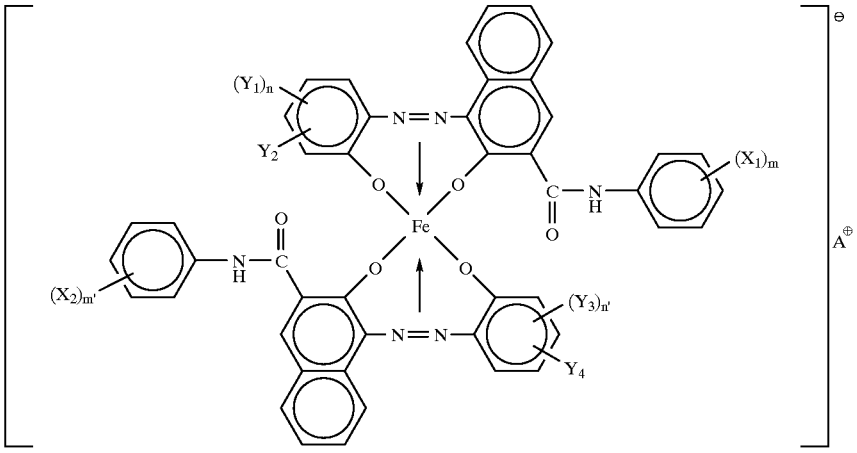

wherein $X_1$ and $X_2$ independently denote hydrogen, lower alkyl, lower alkoxy, nitro or halogen;

m and m' independently denote an integer of 1–3;

$Y_1$ and $Y_3$ independently denote hydrogen, $C_1$–$C_{18}$ alkyl, $C_2$–$C_{18}$ alkenyl, sulfonamide, mesyl, sulfonic acid, carboxy ester, hydroxy, $C_1$–$C_{18}$ alkoxy, acetylamino, benzoyl, amino or halogen;

n and n' independently denote an integer of 1–3;

$Y_2$ and $Y_4$ independently denote hydrogen or nitro; and $A^{\oplus}$ denotes $H^+$, $Na^+$, $K^+$, $NH_4^+$ or a mixture of these ions.

[I]-8

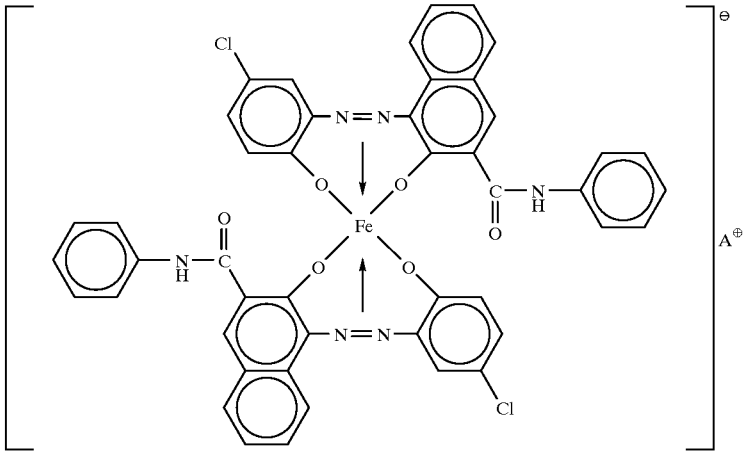

wherein $A^+$denotes $H^+$, $Na^+$, $K^+$, $NH_4^+$or a mixture of these ions.

Basic organic acid metal complexes represented by the following formula [II] impart a negative chargeability and may also be used in the present invention.

[II]

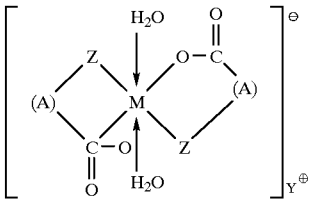

wherein M denotes a coordination center metal, inclusive of metal elements having a coordination number of 6, such as Cr, Co, Ni, Mn and Fe; A denotes

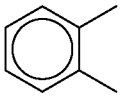

capable of having a substituent, such as an alkyl),

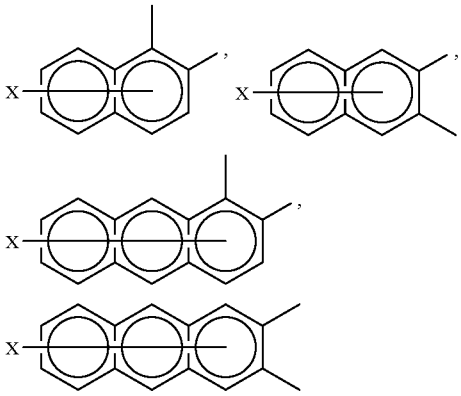

(X denotes hydrogen alkyl, halogen, or nitro),

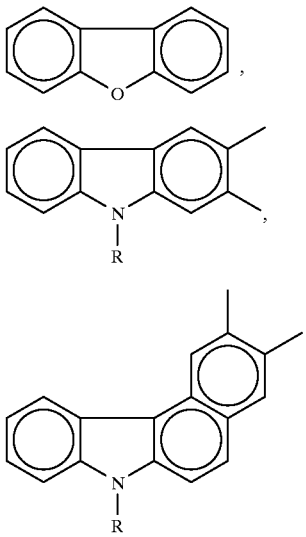

(R denotes hydrogen, $C_1$–$C_{18}$ alkyl or $C_1$–$C_{18}$ alkenyl); $Y^{\oplus}$ denotes a counter ion, such as hydrogen, sodium, potassium, ammonium, or aliphatic ammonium; and Z denotes —O— or —CO.O—.

Specific examples of the metal-containing organic compounds represented by the above formula [II] may include the following:

[II]-1
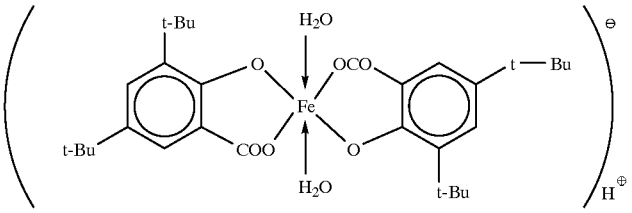
[II]-2
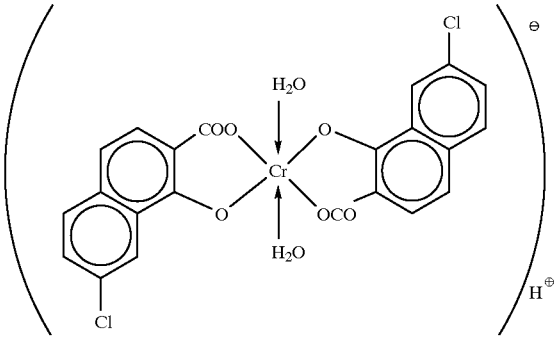
[II]-3
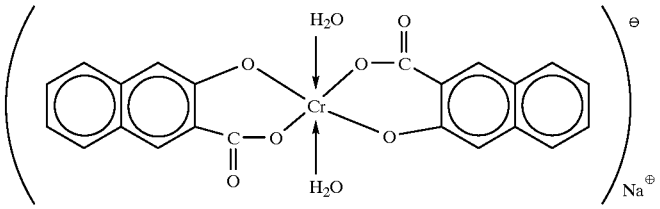
[II]-4
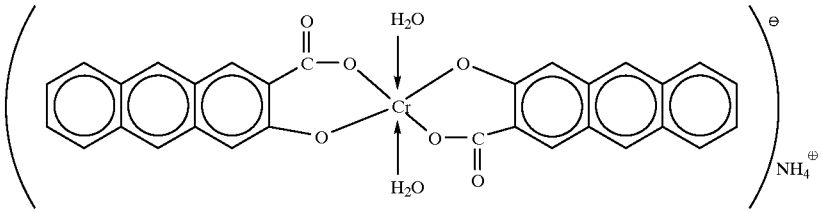
[II]-5
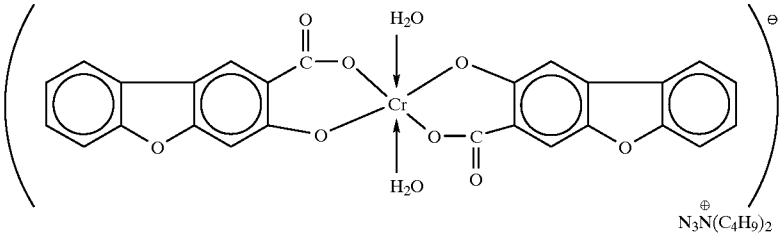
[II]-6
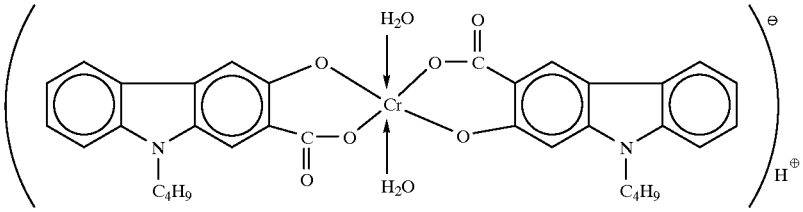

-continued

[II]-7

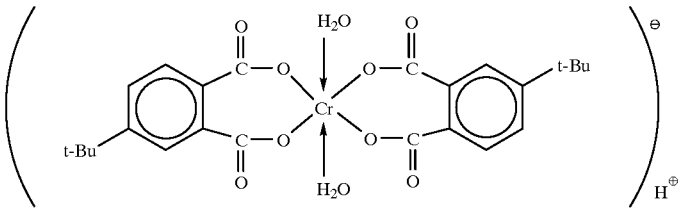

[II]-8

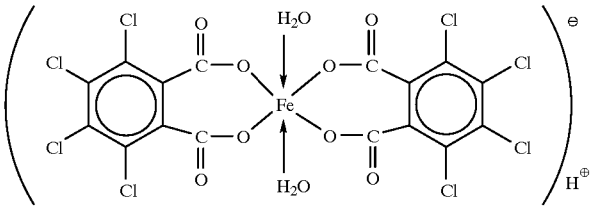

[II]-9

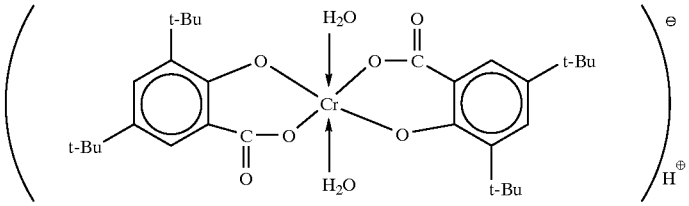

[II]-10

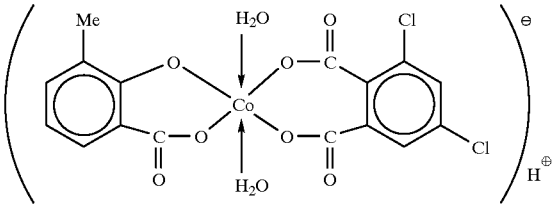

The above organic metal compounds may be used singly or in combination of two or more species.

The addition amount of the organic metal compounds to the toner particles may preferably be 0.1–5 wt. parts, per 100 wt. parts of the binder resin.

The toner according to the present invention may preferably be mixed with inorganic fine powder or hydrophobic inorganic fine powder externally added thereto. For example, silica fine powder, titanium oxide fine powder or hydrophobized products thereof may be used separately or in combination.

The silica fine powder used for this purpose can be either the so-called "dry process silica" (or "fumed silica") which can be obtained by oxidation of gaseous silicon halide, or the so-called "wet process silica" which can be produced from water glass, etc. Among these, the dry process silica is preferred to the wet process silica because the amount of the silanol group present on the surfaces or in interior of the particles is small and it is free from production residue.

It is preferred that the silica fine powder has been subjected to a hydrophobicity-imparting treatment. For the hydrophobicity-imparting treatment, the silica fine powder may be chemically treated with, e.g., an organic silicon compound which reacts with or is physically adsorbed by the silica fine powder. A preferred method includes steps of treating dry-process silica fine powder produced by vapor-phase oxidation of silicon halide with a silane coupling agent and, simultaneously therewith or thereafter, treating the silica fine powder with an organic silicon compound, such as silicone oil.

Examples of the silane coupling agent used for the hydrophobicity-imparting treatment of the silica fine powder may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilanemercaptan, trimethylsilyl-mercaptan, triorganosilyl acrylate, vinyldimethyl-acetoxysilane, dimethylethoxysilane, dimethyl-dimethoxysilane, diphenyldiethoxysilane, hexamethyldisiloxane, 1,3-divinyltetramethyldisiloxane, and 1,3-diphenyltetramethyldisiloxane.

The organic silicon compound may for example be silicone oil. The silicone oil may preferably have a viscosity at 25° C. of about 30–1,000 centi-stokes and may preferably include, for example, dimethylsilicone oil, methylphenylsilicone oil, α-methylstyrene-modified silicone oil, chlorophenylsilicone oil, and fluorinated silicone oil.

The treatment with silicone oil may be performed, e.g., by directly mixing the silica fine powder treated with silane coupling agent with silicone oil by a mixer such as a Henschel mixer, by spraying silicone oil onto the silica fine powder, or by mixing a solution or dispersion of silicone oil in an appropriate solvent with the silica fine powder, followed by removal of the solvent.

It is preferred that silica fine powder is treated with dimethyldichlorosilane, then with hexamethyldisilazane and then with silicone oil. In this way, it is preferred that silica fine powder is first treated with at least two silane coupling agents and then with an oil, in order to provide an effectively increased hydrophobicity.

The above-mentioned hydrophobicity-imparting treatment or silica fine powder may be equally applicable also to titanium oxide fine powder, and the treated titanium oxide fine powder may be equally preferably used in the present invention.

An external additive other than silica or titanium oxide fine powder may be added, as desired, to the toner according to the present invention.

Examples of such an external additive may include resin fine particles and inorganic fine particles functioning as a chargeability improver, an electroconductivity-imparting agent, a flowability improver, an anti-caking agent, a release agent at the time of hot roller fixation, a lubricant, an abrasive, etc.

Such resin fine particles may preferably have an average particle size of 0.03–1.0 $\mu$m. Such resin fine particles may be constituted by polymerization of a monomer, examples of which may include: styrene monomers, such as styrene, o-methylstyrene, m-methylstyrene, p-methylstyrene, p-methoxystyrene, and p-ethylstyrene; unsaturated acids, such as acrylic acid and methacrylic acid; acrylates, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylates, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile, and acrylamide.

The polymerization may be performed according to suspension polymerization, emulsion polymerization, soap-free polymerization, etc. It is particularly preferred to use resin fine particles obtained through soap-free polymerization.

The resin fine particles having the above-mentioned characteristic have been confirmed to exhibit a remarkable effect of preventing toner sticking onto a photosensitive member in a system using a contact charger in the form of a roller, a brush, a blade, etc., as a primary charger.

Examples of other additives may include: lubricants, such as polytetrafluoroethylene, zinc stearate, and polyvinylidene fluoride, of which polyvinylidene fluoride is particularly preferred; abrasives, such as cerium oxide, silicon carbide, and strontium titanate, of which strontium titanate is particularly preferred; flowability-improvers, such as titanium oxide and aluminum oxide, which may have preferably been hydrophobicity-imparted; anticaking agents; electroconductivity-imparting agents, such as carbon black, zinc oxide, antimony oxide, and tin oxide. It is also possible to add white and black fine particles having a chargeability to a polarity opposite to that of the toner particles, as a developing characteristic-improving agent.

The inorganic fine powder or hydrophobic inorganic fine powder to be mixed with the toner may preferably be added in a proportion of 0.1–5 wt. parts, more preferably 0.1–3 wt. parts, per 100 wt. parts of the toner particles.

The toner according to the present invention may be produced by sufficiently mixing the polymer components, a pigment or dye or magnetic material as colorant, a charge controller, another additive, etc., by means of a mixer such as a ball mill, etc.; then melting and kneading the mixture by hot kneading means such as hot rollers, kneader and extruder to disperse or dissolve the additives, in the melted resin (polymer components); cooling and pulverizing the mixture; and subjecting the powder product to precise classification to form the toner particles according to the present invention.

Alternatively, it is also possible to provide a toner through polymerization. According to the polymerization method, a polymerizable monomer, a charge-controlling agent, a pigment, dye or magnetic material, a polymerization initiator, and optionally a crosslinking agent, and other additives, as desired, may be uniformly dissolved or dispersed to form a monomer composition. Then, the monomer composition or a preliminarily polymerized product thereof is dispersed in a continuous phase (e.g., of water) by means of an appropriate stirrer, and then subjected to polymerization to recover magnetic toner particles having a desired particle size. In case of using a magnetic iron oxide in the polymerization method, it is preferred to subject the magnetic iron oxide particles in advance to a hydrophobicity-imparting treatment.

An embodiment of the image forming method will now be described with reference to FIG. 6.

The surface of a photosensitive drum (electrostatic image-bearing member) 1 is negatively charged by a primary charger 742, subjected to image-scanning with laser light 705 to form a digital latent image, and the resultant latent image is reversely developed with a monocomponent magnetic toner 710 in a developing apparatus 709 which comprises a developing sleeve 704 equipped with a magnetic blade 711 and enclosing a magnet. In the developing zone, the electroconductive support of the photosensitive drum is grounded, and an alternating bias, pulse bias and/or DC bias is applied to the developing sleeve 704 by a bias voltage application means 712. When a transfer-receiving paper P is conveyed to a transfer zone, the paper is charged from the back side (opposite side with respect to the photosensitive drum) by a roller transfer means 2 connected to a voltage supply 3, whereby the developed image (toner image) on the photosensitive drum is transferred to the transfer paper P by the contact transfer means 2. Then, the transfer paper P is separated from the photosensitive drum 1 and subjected to fixation by means of a hot pressing roller fixer 707 for fixing the toner image on the transfer paper P.

It is possible that the toner image on the photosensitive drum is transferred to the transfer-receiving paper P, after being once transferred onto an intermediate transfer member, such as an intermediate transfer drum or an intermediate transfer belt.

Residual monocomponent magnetization remaining on the photosensitive drum after the transfer step is removed by a cleaning means 708 comprising a cleaning blade. The photosensitive drum 1 after the cleaning is subjected to erase-exposure for discharge by erasure means 706 and then subjected to a repeating cycle commencing from the charging step by the primary charger 702.

The photosensitive drum (electrostatic image-bearing member) 1 comprises a photosensitive layer and a conductive substrate and rotates in the direction of the arrow. The developing sleeve 704 comprising a non-magnetic cylinder as a toner-carrying member rotates so as to move in the same direction as the photosensitive drum 1 surface at the developing zone. Inside the non-magnetic cylinder sleeve 6, a multi-pole permanent magnet (magnet roll) as a magnetic field generating means is disposed so as not to rotate. The monocomponent insulating magnetic toner 710 in the developing apparatus 709 is applied onto the non-magnetic cylinder sleeve 704 and the toner particles are provided with, e.g., a negative triboelectric charge due to friction between the sleeve 704 surface and the toner particles. Further, by disposing an elastic doctor blade 711 so as to be pressed against the sleeve surface, the thickness of the magnetic toner layer is regulated at a thin and uniform thickness (30–300 $\mu$m) which is thinner than the spacing between the photosensitive drum 1 and the developing sleeve 704 at the developing zone. The rotation speed of the sleeve 704 is so adjusted that the circumferential velocity of the sleeve 704 is substantially equal to or close to that of the photosensitive drum surface. In the developing zone, an AC bias or a pulsed bias may be applied to the sleeve 704 by the biasing means 712. The AC bias may preferably comprise f=200–4000 Hz and Vpp=500–3000 V.

In the developing zone, the toner particles are transferred to the electrostatic image under the action of an electrostatic force exerted by the surface of the photosensitive drum 1 and the AC bias or pulsed bias.

It is also possible to replace the elastic blade 711 with a magnetic doctor blade formed, e.g., of iron.

Figure 2:
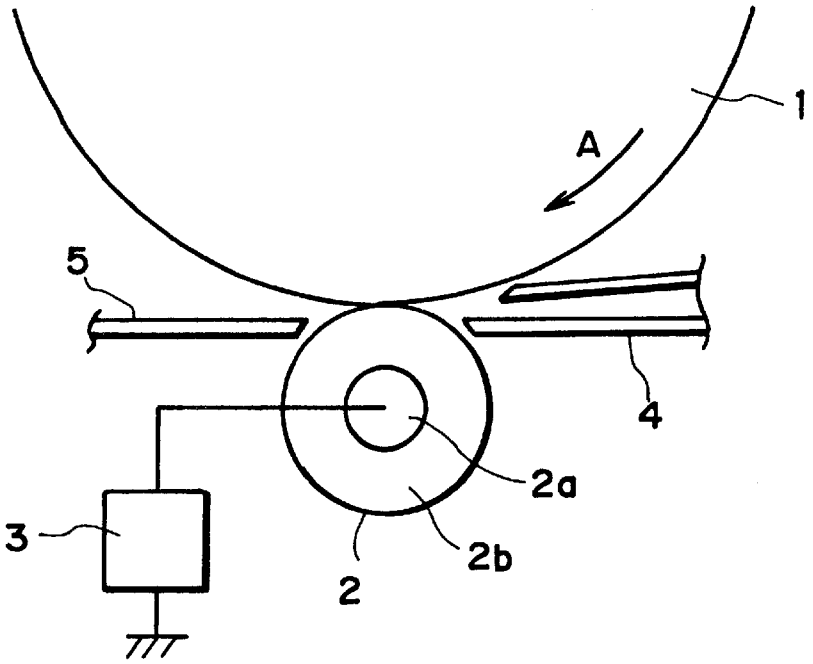
FIG. 2 is a schematic illustration of a transfer apparatus.

FIG. 2 shows a detail of a contact transfer system (as used in the image forming apparatus shown in FIG. 6), including a transfer roller 2 which basically comprises a core metal 2*a* and an electroconductive elastic layer 2*b* surrounding the core metal 2*a*. The transfer roller 2 is used to press a transfer material against the surface of the photosensitive drum 1 at a pressing force. The transfer roller 2 rotates at a peripheral speed which is equal to or different from that of the photosensitive drum 1. A transfer material (such as paper) is conveyed through a guide 4 to between the photosensitive drum 1 and the transfer roller 2, where the transfer roller is supplied with a bias voltage of a polarity opposite to that of the toner from a transfer bias voltage supply 3 so that the toner image on the photosensitive drum 1 is transferred onto the face side of the transfer material. Then, the transfer material carrying the transferred toner image is sent through a guide 5 to a fixing device.

The electroconductive elastic layer 2*b* may preferably comprise an elastic material, such as urethane rubber or ethylene-propylene-diene terpolymer (EPDM), containing an electroconductive filler, such as conductive carbon, dispersed therein and having a volume resistivity in the range of ca. $10^6$–$10^{10}$ ohm.cm.

Preferred transfer conditions may include a roller abutting pressure of 5–500 g/cm and a DC voltage of ±0.2–±10 kV.

Figure 3:
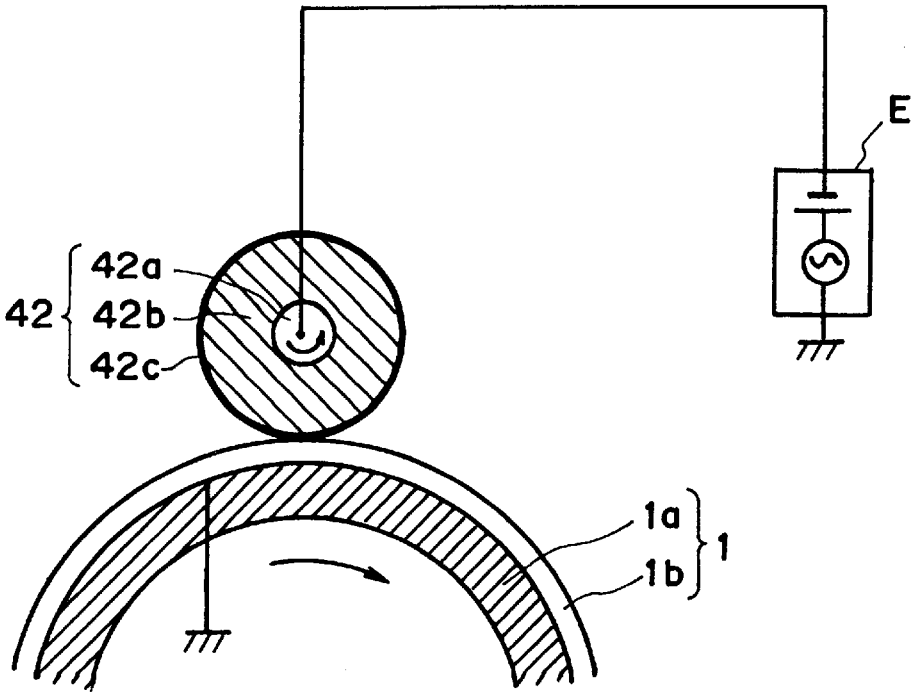
FIG. 3 is a schematic illustration of a charging roller.
Figure 4:
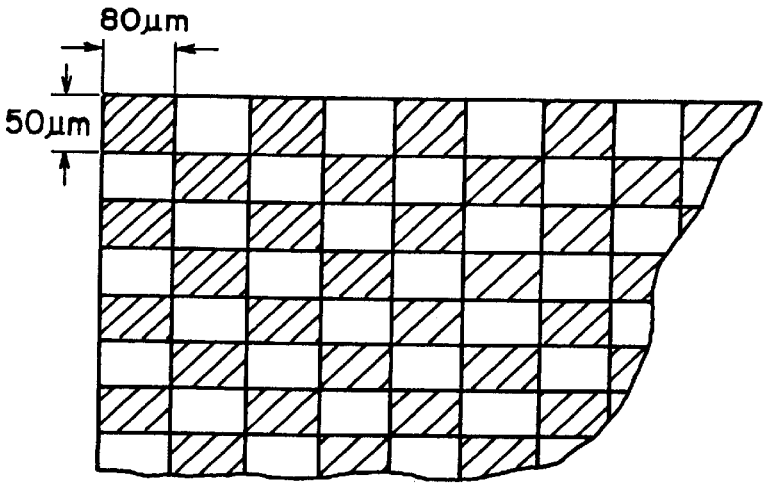
FIG. 4 is an illustration of a checker pattern for testing the developing performance of a magnetic toner.
Figure 6:
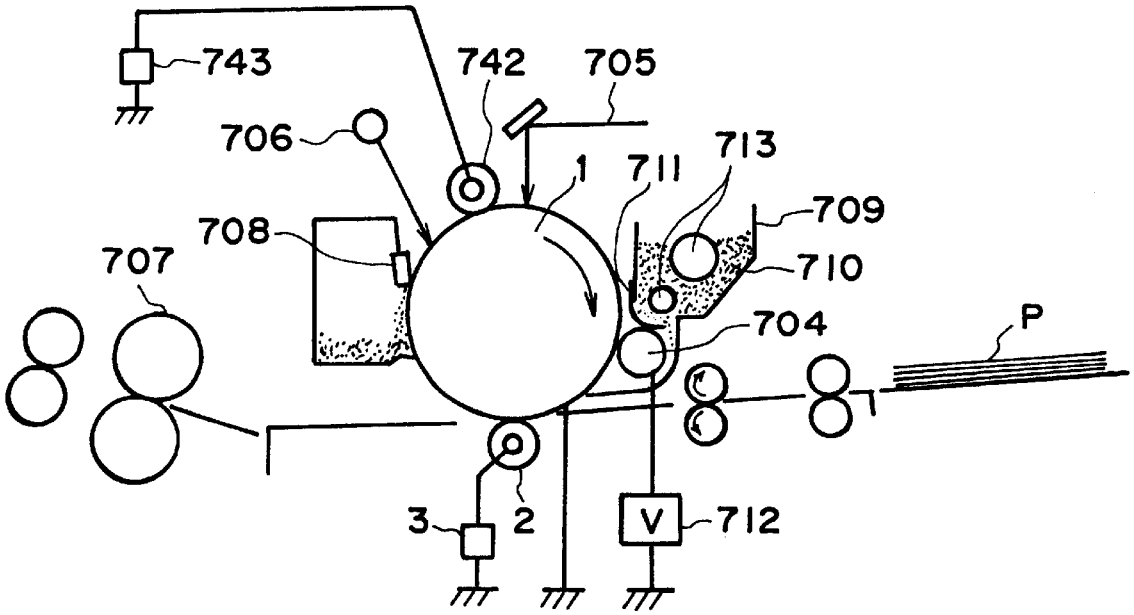
FIG. 6 is a schematic illustration of an example of an image forming apparatus suitable for image formation using a toner according to the invention.

FIG. 3 shows a detail of a contact-charging system (as used in image forming apparatus shown in FIG. 6). The system includes a rotating drum-shaped electrostatic image bearing member (herein, simply referred to as "photosensitive drum") 1, which basically comprises an electroconductive support layer 1*a* of, e.g., aluminum, and a photoconductor layer 1*b* coating the outer surface of the support layer 1*a*, and rotates at a prescribed peripheral speed (process speed) in a clockwise direction (in the case shown on the drawing).

The photosensitive drum 1 is charged with a charging roller 42 which basically comprises a core metal 42*a*, an electroconductive elastic layer 42*b* surrounding the core metal 42*a*, and a surface layer 42*c*. The charging roller 42 is pressed against the surface of the photosensitive drum 1 at a pressing force and rotates so as to follow the rotation of the photosensitive drum 1. The charging roller 42 is supplied with a voltage from a bias voltage application means E, whereby the surface of the photosensitive drum 1 is charged to a prescribed potential of a prescribed polarity. Then, the photosensitive drum 1 is exposed imagewise to form an electrostatic image thereon, which is then developed into a visual toner image by a developing means.

Preferred process conditions of such a charging roller may for example comprise a roller abutting pressure of 5–500 g/cm and a combination of an AC voltage of 0.5–5 kVpp and frequency of 50 Hz to 5 kH and a DC voltage of ±0.2–+1.5 kV in case of DC-AC superposed voltage application or a DC voltage of ±0.2–±5 kV in case of DC voltage application.

The charging roller may preferably comprise an electroconductive rubber and can be surfaced with a release film, which may for example comprise nylon resin, PVDF (polyvinylidene fluoride), or PVDC (polyvinylidene chloride).

The charging roller can be replaced with another contact charging means, such as a charging blade or a charging brush.

Figure 7:
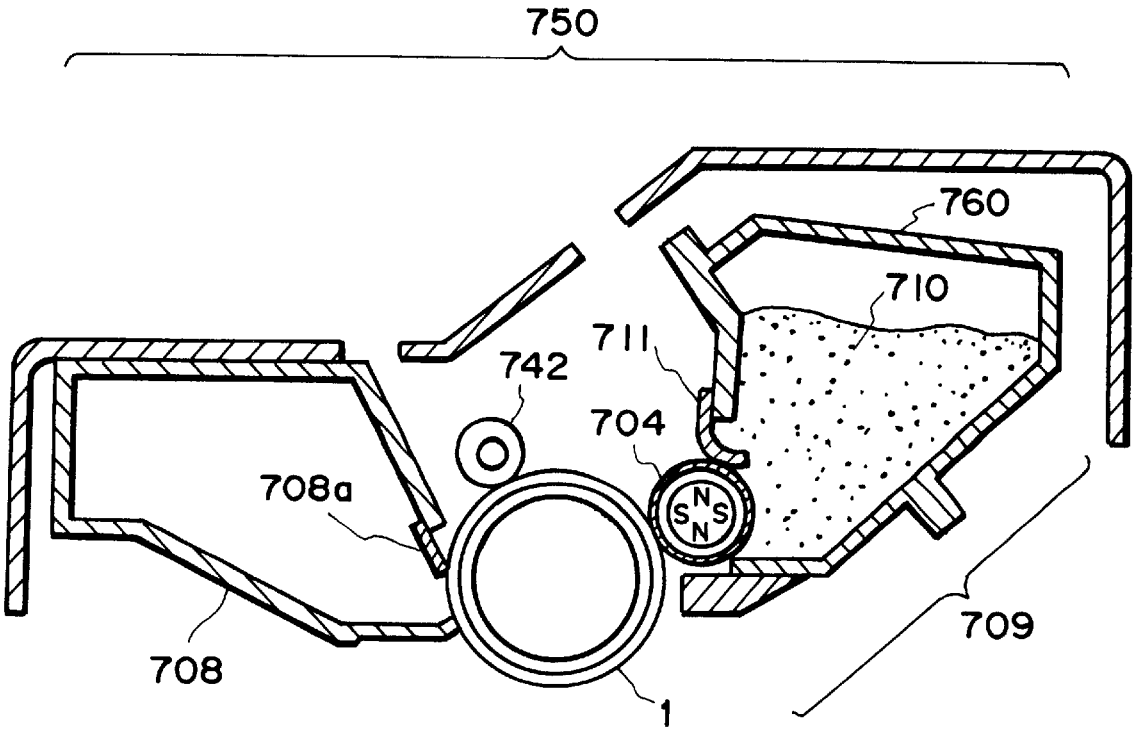
FIG. 7 is a view for illustrating an embodiment of the process-cartridge according to the invention.

FIG. 7 shows an embodiment of the process cartridge according to the invention. The process cartridge includes at least a developing means and an electrostatic image bearing member integrated into a form of a cartridge, which is detachably mountable to a main assembly of an image forming apparatus (such as a copying machine and a laser beam printer).

In this embodiment, a process cartridge is shown to integrally include a developing means 709, a drum-shaped electrostatic image-bearing member (photosensitive drum) 1, a cleaner 708 having a cleaning blade 708*a*, and a primary charger (charging roller) 742.

In the cartridge of this embodiment, the developing means 709 comprises an elastic blade 711 and a toner 760 containing a magnetic toner 710. The magnetic toner is used for development in such a manner that a prescribed electric field is formed between the photosensitive drum 1 and a developing sleeve 704. In order to perform the development suitably, it is very important to accurately control the spacing between the photosensitive drum 1 and the developing sleeve 704.

Hereinbelow, the present invention will be described based on specific Examples.

Production Example 1 for Resin Composition

Synthesis of Low-molecular Weight Polymer (L-1)

300 wt. parts of xylene was placed in a four-necked flask, and the interior of the flask was sufficiently aerated with nitrogen under stirring. Then, the xylene was heated and subjected to refluxing.

Under the refluxing condition, a mixture of 75 wt. parts of styrene, 18 wt. parts of n-butyl acrylate, 7 wt. parts of monobutyl maleate and 2 wt. parts of di-tert-butyl peroxide was added dropwise in 4 hours. The system was held for 2 hours to complete the polymerization to obtain a solution of Low-molecular weight polymer (L-1).

A part of the polymer solution was sampled and dried under a reduced pressure to recover Low-molecular weight polymer (L-1), which was then subjected to GPC (gel permeation chromatography) and measurement of glass transition temperature (Tg). As a result, the polymer (L-1) showed a weight-average molecular weight (Mw) of 9,600, a number-average molecular weight (Mn) of 6,000, a peak molecular weight (PMW) of 8,500, a Tg of 62° C., and an acid value ($A_V$) of 25.

The polymer conversion at that time was 97%.

Synthesis of High-molecular Weight Polymer (H-1)

In a four-necked flask, 180 wt. parts of degassed water and 20 wt. parts of 2 wt. % polyvinyl alcohol aqueous solution were placed, and then a mixture liquid of 70 wt. parts of styrene, 25 wt. parts of n-butyl acrylate, 5 wt. parts of monobutyl maleate, 0.005 wt. part of divinylbenzene and 0.1 wt. part of 2,2-bis(4,4-di-tert-butylperoxycyclohexyl) propane (a 10 hour-halflife temperature ($T_{10h}$)=92° C.) was added thereto, followed by stirring to form a suspension liquid.

The interior of the flask was sufficiently aerated with nitrogen, and then the system was heated to 85° C. to initiate the polymerization. After 24 hours at the temperature, 0.1 wt. part of benzoyl peroxide ($T_{10h}$=72° C.) was added, and the system was further held at the temperature for 12 hours to complete the polymerization.

To the suspension liquid after the reaction, an NaOH aqueous solution in an amount of 6 times equivaluent to the acid value (AV=7.8) of the resultant High-molecular weight polymer (H-1) was added, and the system was stirred for 2 hours.

The resultant High-molecular weight polymer (H-1) was filtered out, washed with water, dried and, as a result of measurement, showed Mw=$1.8\times10^6$, PMW=$1.2\times10^6$ and Tg=62° C., and $A_V$=6.

Production of Resin Composition

In a four-necked flask, 100 wt. parts of xylene and 25 wt. parts of the above High-molecular weight polymer (H-1) were placed and heated and stirred under reflux to effect preliminary dissolution. The system was retained for 12 hours in the state to obtain a preliminary solution (Y-1).

Separately, 300 wt. parts of the above-mentioned uniform solution of Low-molecular weight polymer (L-1) was placed in another vessel and refluxed.

The above preliminary solution (Y-1) and Low-weight polymer (L-1) solution were blended under reflux, followed by distilling-off of the organic solvent to recover a resin, which was then cooled and, after being solidified, pulverized to obtain Resin composition (I).

As a result of the measurement, Resin composition (I) showed PMW=$1.1\times10^6$, an areal percentage occupied by a molecular weight portion of $10^6$ or above on its GPC chromatogram (A($\geqq10^6$))=9.2%, Tg=62.5° C., and a THF-insoluble content of 2.1 wt. %.

Various data for Low-molecular weight polymer (I), High-molecular weight polymer (I) and Resin composition (I) are shown in Table 1 appearing hereinbelow together with those obtained in Production Examples described below.

Production Examples 2, 3 and 6 and Comparative Production Example 2 for Resin Compositions Low-molecular weight polymers (L-2) to (L-4) and (L-6) were prepared in similar manners as in the above Production Example 1 while adjusting the amounts of monobutyl maleate, styrene, n-butyl acrylate and polymerization initiators, and blended with High-molecular weight polymer (H-1) in prescribed ratios to prepare Resin compositions (II), (III), (IV) and (ii).

Production Examples 4 and 7, and Comparative Production Example 1 for Resin Compositions Low-molecular weight polymer (L-5) and High-molecular weight polymers (H-2), (H-4) and (H-5) were prepared in similar manners as in the above Production Example 1 while adjusting the amounts of monobutyl maleate, styrene, n-butyl acrylate and polymerization initiators. Then, Low-molecular weight polymers (L-1) and (L-5) were blended with these High-molecular weight polymers in prescribed ratios to obtain Resin compositions (IV), (VII) and (i).

Production Example 5 for Resin Composition

Synthesis of High-molecular Weight Polymer (H-3)

In a four-necked flask, 85 wt. parts of styrene and 15 wt. parts of butyl methacrylate were placed and subjected to bulk polymerization, followed by addition of 300 wt. parts of xylene and 0.1 wt. part of benzoyl peroxide (polymerization initiator) and solution polymerization, to obtain High-molecular weight polymer (H-3).

Production of Resin Composition (V)

Resin composition (V) was prepared in a similar manner as in Production Example 1 except for mixing High-molecular weight polymer (H-3) in a prescribed ratio with Low-molecular weight polymer (L-1).

Details of Low- and High-molecular weight polymers and Resin compositions prepared above ate shown in the following Table 1.

TABLE 1

| | | Low-molecular weight polymer | | | | | Low/High blend | High-molecular weight polymer | | | | | Composition | |
|---|---|---|---|---|---|---|---|---|---|---|---|---|---|---|
| Prod. Ex. | Resin comp. | | Mw | PMW | Tg (°C.) | $A_{VL}'$ (mgKOH/g) | ratio ($W_L/W_H$) | | Mw (× $10^4$) | PMW (× $10^4$) | Tg (°C.) | $A_{VH}'$ (mgKOH/g) | A ($\geqq10^6$) (area %) | THF-ins (wt. %) |
| 1 | I | L-1 | 9600 | 8500 | 62 | 25.0 | 75/25 | H-1 | 180 | 120 | 62 | 6.0 | 9.2 | 2.1 |
| 2 | II | L-2 | 5000 | 3700 | 64 | 26.3 | 50/50 | H-1 | 180 | 120 | 62 | 6.0 | 16.4 | 3.5 |
| 3 | III | L-3 | 30000 | 28000 | 62 | 33.8 | 90/10 | H-1 | 180 | 120 | 62 | 6.0 | 4.0 | 1.0 |
| 4 | IV | L-1 | 9600 | 8500 | 62 | 25.0 | 70/30 | H-2 | 120 | 83 | 61 | 0.6 | 4.0 | 0.9 |
| 5 | V | L-1 | 9600 | 8500 | 62 | 25.0 | 50/50 | H-3 | 90 | 50 | 64 | 2.9 | 0.2 | 0.1 |
| 6 | VI | L-4 | 9700 | 8500 | 62 | 16.5 | 75/25 | H-1 | 180 | 120 | 62 | 6.0 | 9.0 | 2.0 |
| 7 | VII | L-1 | 9600 | 8500 | 62 | 25.0 | 75/25 | H-4 | 180 | 125 | 61 | 21.2 | 9.3 | 3.0 |
| Comp. Ex. 1 | i | L-5 | 9800 | 8600 | 62 | 0 | 75/25 | H-5 | 180 | 120 | 62 | 0 | 9.2 | 2.1 |
| 2 | ii | L-6 | 40000 | 37000 | 63 | 23.0 | 65/35 | H-1 | 180 | 120 | 62 | 6.0 | 11.5 | 3.8 |

EXAMPLE 1

| | |
|---|---|
| Resin composition (I) | 100 wt. parts |
| Magnetic iron oxide (average particle size (Dav.) = 0.2 μm | 100 wt. parts |
| Propylene/ethylene (92/8) copolymer wax graft-copolymerized with maleic anhydride (A.V. = 3.5; Mw = 9000) | 4 wt. parts |
| Negative charge controlling agent of the formula below | 2 wt. parts |

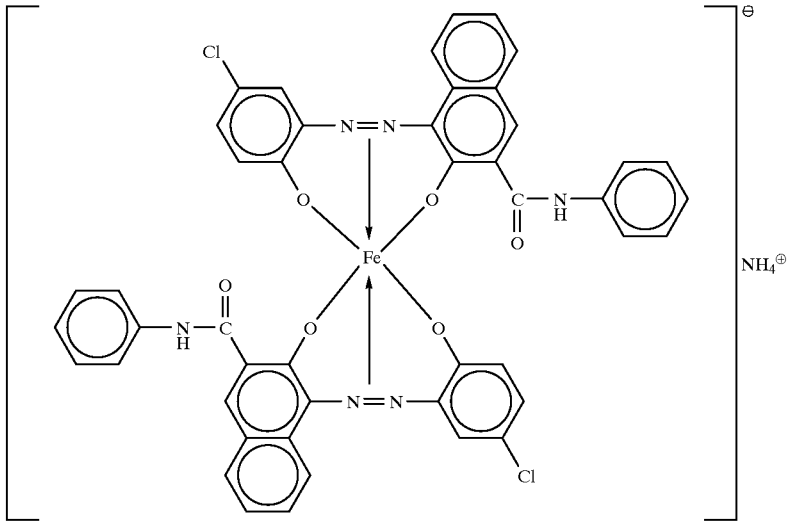

The above ingredients were melt-kneaded through a twin-screw extruder heated at 140° C. The kneaded product was cooled, coarsely crushed by a hammer mill and finely pulverized by a jet mill. The pulverized product was classified by a fixed wall pneumatic classifier to obtain coarsely classified powder, which was then subjected to classification by means of a multi-division classifier utilizing the Coanda effect ("Elbow Jet" classifier, available from Nittetsu Kogyo K.K.) to strictly remove ultra-fine powder and coarse powder simultaneously to obtain a negatively chargeable magnetic toner having a weight-average particle size ($D_4$) of 6.1 μm. The thus-obtained toner showed physical properties shown in Tables 2 and 3 and provided a GPC chromatogram shown in FIG. 5.

100 wt. parts of the above-prepared magnetic toner was blended with 1.2 wt. parts of hydrophobic silica fine powder (having a BET specific surface area ($S_{BET}$) of 160 $m^2/g$, prepared by successive treatments with dimethyldichlorosilane, hexamethyldisilazane and dimethylsilicone oil in this order) and 0.08 wt. part of styrene-acrylate copolymer fine particles (Dav.=0.05 μm, prepared by soap-free polymerization) by means of a Henschel mixer to obtain a magnetic toner (Toner A).

EXAMPLES 2–9 AND COMPARATIVE EXAMPLES 1–3

Negatively chargeable magnetic toners (Toners B to I and Toners (a) to (c)) were prepared in similar manners as in Example 1 except for using Resin compositions (II) to (VII) and (i) to (ii) and using waxes of specified species and specified acid values shown in Table 2. The other particulars and physical properties of the toners are also shown in Tables 2 and 3.

TABLE 2

Properties of magnetic toners

| | | GPC M. W. distribution | | | | | | | | Magnetic toner | | |
|---|---|---|---|---|---|---|---|---|---|---|---|---|
| Example | Toner | (1) Low M. W.-side peak value LMp | (2) High M. W.-side peak value HMp (×10⁴) | Min. (×10⁴) | A (≧10⁶) (%) | $THF_{ins}$ (wt. %) | Resin comp. | Wax (3)–(6) | $A_{VWax}$ (mgKOH/g) | $D_4$ (μm) | N (≦3.17 um) (% by number) | Void ratio |
| Ex. 1 | A | 8100 | 67 | 6 | 5.1 | 0.9 | I | MA-modified PP-PE | 3.5 | 6.10 | 18.5 | 0.54 |
| 2 | B | 3600 | 62 | 4.5 | 9.2 | 1.4 | II | MA-modified PP-PE | 7.0 | 6.03 | 17.1 | 0.55 |
| 3 | C | 26000 | 68 | 9 | 3.0 | 0.4 | III | MA-modified PP | 13.0 | 5.92 | 18.6 | 0.55 |
| 4 | D | 8100 | 42 | 5 | 2.0 | 0.3 | IV | MA-modified PP | 7.0 | 6.11 | 17.3 | 0.53 |
| 5 | E | 8100 | 27 | 3 | 9.8 | 0.1 | V | MA-modified PP | 3.5 | 5.87 | 19.2 | 0.54 |
| 6 | F | 8200 | 67 | 6 | 5.0 | 0.9 | VI | MA-modified PP-PE | 7.0 | 6.10 | 18.4 | 0.54 |
| 7 | G | 8100 | 69 | 6 | 5.2 | 1.1 | VII | MA-modified PP | 3.5 | 5.83 | 19.8 | 0.53 |
| 8 | H | 8100 | 67 | 6 | 5.1 | 0.9 | I | MA-modified PP-PE | 1.5 | 6.04 | 19.3 | 0.55 |

TABLE 2-continued

Properties of magnetic toners

| Example | Toner | GPC M. W. distribution (1) Low M. W.-side peak value LMp | (2) High M. W.-side peak value HMp ($\times 10^4$) | Min. ($\times 10^4$) | A ($\geqq 10^6$) (%) | $THF_{ins}$ (wt. %) | Resin comp. | Wax (3)–(6) | $A_{VWax}$ (mgKOH/g) | Magnetic toner $D_4$ ($\mu$m) | N ($\leqq$3.17 um) (% by number) | Void ratio |
|---|---|---|---|---|---|---|---|---|---|---|---|---|
| 9 | I | 8100 | 67 | 6 | 5.1 | 0.9 | I | MA-modified PP-PE | 11.0 | 6.11 | 18.2 | 0.54 |
| Comp. Ex. 1 | a | 8200 | 67 | 6 | 5.2 | 0.8 | i | MA-modified PP | 7.0 | 6.01 | 19.2 | 0.55 |
| 2 | b | 32000 | 80 | 14 | 10.3 | 3.3 | ii | MA-modified PP | 7.0 | 5.84 | 19.6 | 0.54 |
| 3 | c | 8100 | 69 | 6 | 5.2 | 1.1 | VII | PE | 0 | 6.01 | 17.4 | 0.55 |

(1) An underlined value represents a molecular weight at a main peak.
(2) All HMp corresponded to sub-peaks.
(3) PP-PE: propylene-ethylene copolymer wax.
(4) PP: Propylene polymer wax.
(5) PE: Ethylene polymer wax.
(6) MA: Maleic anhydride

TABLE 3

Properties of polymer components in toners

| Toner | $A_{VL}$ (mgKOH/g) | $A_{VH}$ (mgKOH/g) | $A_{VL} - A_{VH}$ | $A_{VL} \times W_L/W_L + W_H$ | $A_{VH} \times W_H/W_L + W_H$ | $1/W_L + W_H$ | $(A_{VL}W_L + A_{VH} + W_H)$ | $A_V/TA_V$ | $T_{gL}$ (°C.) | $T_{gH}$ (°C.) |
|---|---|---|---|---|---|---|---|---|---|---|
| A | 23.0 | 7.0 | 16.0 | 17.3 | 1.8 | 19.0 | | 0.44 | 62 | 62 |
| B | 21.0 | 7.0 | 14.0 | 10.5 | 3.5 | 14.0 | | 0.58 | 64 | 62 |
| C | 32.5 | 7.0 | 25.5 | 29.3 | 0.7 | 30.0 | | 0.50 | 62 | 62 |
| D | 23.0 | 0.7 | 22.3 | 16.1 | 0.2 | 16.3 | | 0.53 | 62 | 61 |
| E | 23.0 | 3.5 | 19.5 | 11.5 | 1.8 | 13.3 | | 0.63 | 62 | 64 |
| F | 16.0 | 7.0 | 9.0 | 12.0 | 1.8 | 13.8 | | 0.49 | 62 | 62 |
| G | 24.8 | 23.0 | 1.8 | 18.6 | 5.75 | 24.35 | | 0.61 | 62 | 61 |
| H | 23.0 | 7.0 | 16.0 | 17.3 | 1.8 | 19.0 | | 0.44 | 62 | 62 |
| I | 23.0 | 7.0 | 16.0 | 17.3 | 1.8 | 19.0 | | 0.44 | 62 | 62 |
| a | 0.7 | 7.0 | −6.3 | 0.5 | 1.8 | 2.3 | | 0.82 | 62 | 62 |
| b | 21.0 | 7.0 | 14.0 | 17.9 | 1.1 | 18.9 | | 0.65 | 63 | 62 |
| c | 24.8 | 23.0 | 1.8 | 18.6 | 5.75 | 24.35 | | 0.61 | 62 | 61 |

[Image Forming Test]

Each magnetic toner was charged in a process-cartridge and incorporated in a laser beam printer (prepared by remodeling a commercially available laser beam printer using an OPC photosensitive drum ("LBP-A309 GII", available from Canon K.K.) so as to increase the process speed from 16 sheets/min. to 36 sheets/min. of A4-size laterally fed paper sheet and incorporate a contact transfer device as shown in FIG. 2). The process speed at that time was 165 mm/sec.

The contact transfer device included a transfer roller surfaced with an electroconductive rubber layer comprising EPDM (ethylene-propylenediene terpolymer) containing electroconductive carbon dispersed therein and showing a volume resistivity of $10^8$ ohm.cm and a surface rubber hardners of 27 deg. The transfer roller was driven under conditions including a transfer current of 1 $\mu$A, a transfer voltage of +2000 V, and an abutting pressure of 50 g/cm.

The photosensitive drum 1 was primarily charged by a charging roller 42 as shown in FIG. 3 and also incorporated in the process cartridge. The charging roller 42 had an outer diameter of 12 mm and comprised an electroconductive rubber layer 42*b* of EPDM and a 10 $\mu$m-thick surface layer 42*c* of nylon resin. The charging roller 42 showed a hardness of 54.5 degrees (ASKER-C). The charging roller 42 was supplied with a prescribed voltage through the core metal 42*a* from a bias voltage supply E supplying a DC voltage superposed with an AC voltage.

In the process cartridge, a urethane rubber-made application blade (711) was disposed to be pressed against a developing sleeve (704) so as to triboelectrically charge the toner (FIG. 7).

Then, image formation was performed in the following manner. An OPC photosensitive drum 1 was primarily charged at −700 V by the charging roller 42, and an electrostatic latent image for reversal development was formed thereon. The toner was formed in a layer on a developing sleeve (containing magnet) so as not to contact the photosensitive drum at the developing position. An AC bias (f=1,800 Hz and Vpp=1,600 V) and a DC bias ($V_{DC}$=−500 V) were applied to the sleeve, and an electrostatic image having a light-part potential of −170 V was developed by the reversal development mode, to form a magnetic toner image on the OPC photosensitive drum.

The thus-formed magnetic toner image was transferred to plain paper under application of the above-mentioned positive transfer voltage, and then fixed to the plain paper by passing through a hot-pressure roller fixer, wherein the hot roller surface temperature was set to 190° C., and a total pressure of 19 kg was applied between the hot roller and the pressure roller to provide a nip of 6 mm.

Under the above-set conditions, an image forming test was performed in an intermittent print mode of 2 sheets/20 sec in a high temperature/high humidity environment (HT/HH=32.5° C./85% RH) and a low temperature/low humidity environment (LT/LH=10° C./15% RH), respectively. The resultant images were evaluated with respect to the following items and the results are inclusively shown in Table 4 appearing hereinafter.

1) Image Density

The density of an image formed on an ordinary plain paper for copying machine (75 g/m$^2$) after printing 10,000 sheets was measured by a Macbeth Reflection Densitometer (available from Macbeth Co.) as a relative density against a density of 0.00 allotted to a printed white background portion.

2) Fog

Fog (%) was evaluated as a difference between the whiteness of a white background portion of a printed image and the whiteness of an original transfer paper by measurement with "Reflectometer" (available from Tokyo Denshoku K.K.). The printing was performed in an intermittent mode of 2 sheets/20 sec in a low temperature/low humidity environment (15° C./10% RH).

3) Image Quality

Figure 5:
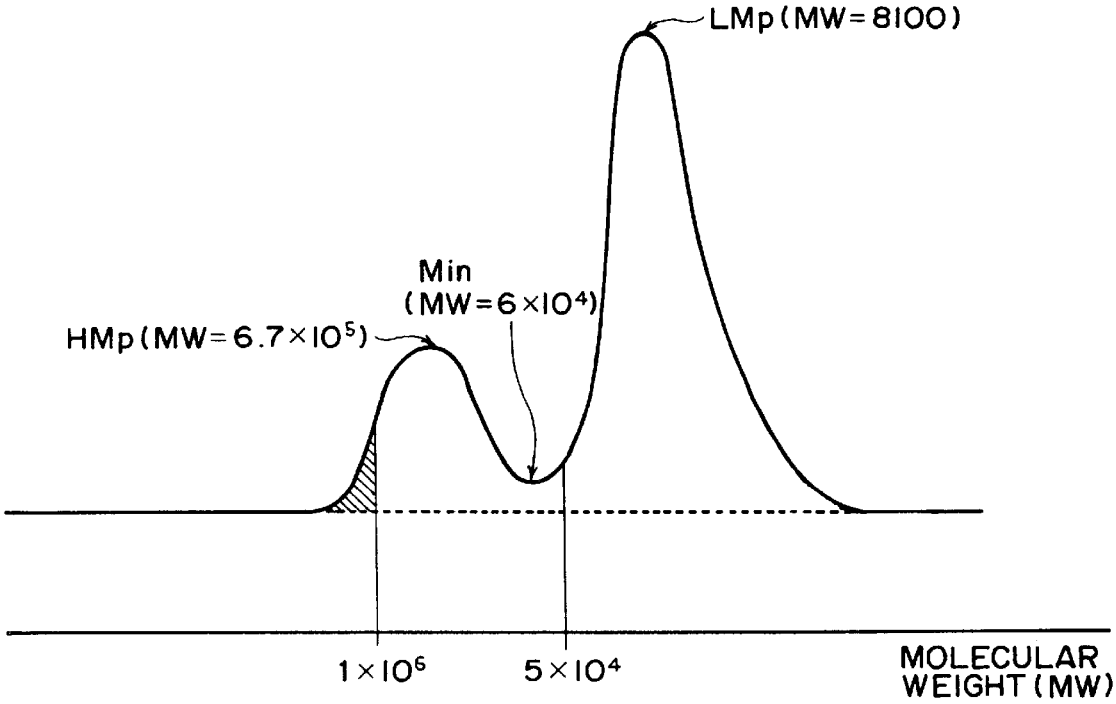
FIG. 5 is a chart showing a GPC chromatogram of a resin according to Example 1 described hereinafter.

A checker pattern shown in FIG. 5 was printed out and the dot reproducibility was evaluated by counting the number of lacked dots. The results were evaluated according to the following standards:

A (very good): lack of 2 dots or less/100 dots

B (good): lack of 3–5 dots/100 dots

C (practically acceptable):
lack of 6–10 dots/100 dots

D (practically unacceptable):
lack of 11 dots or more/100 dots.

4) Image Density Uniformity

A wholly solid black sample image was printed on an A4-size sheet, and a difference between the highest image density and the lowest image density on the sheet was recorded as an indication of image density irregularity.

[Fixability, Anti-offset Characteristic Test]

Each magnetic toner was charged in a process-cartridge and incorporated into a laser beam printer (prepared by remodeling a commercially available laser beam printer ("LBP-309 GII", available from Canon K.K.) so as to increase the process speed from 16 sheets/min. to 24 sheets/min. (total pressure=18 kg) and allow an adjustment from outside of the hot roller surface temperature of the hot-pressure fixer in the range of 140–230° C. Printing of a sample image was performed under basically identical conditions as in the above-described image forming test in a normal temperature/normal humidity environment (NT/NH=20° C./60% RH) while successively changing the set fixing temperature at an increment of 5° C. each. Fixed images were evaluated in the following manner and the results are also shown in Table 4.

1) Fixability

Fixed images were rubbed with a soft tissue paper under a load of 50 g/cm$^2$, and the fixability was evaluated in terms of a lowest fixable temperature (Tmin.) which is the lowest temperatures among various fixing temperature giving a lowering (%) in image density after the rubbing of at most 10%. The fixed images were formed on plain paper (75 g/m$^2$) for copying machines, on which toner image fixation is relatively difficult, as a test paper.

2) Anti-offset Characteristic

A sample image having an image area percentage of 5% was printed out, and the anti-offset characteristic was evaluated in terms of a highest temperature (Tmax) producing printed and fixed images free from soiling due to offset phenomenon. The test paper used was a plain paper (65 g/m$^2$) for copying.

The results are shown in the following Table

TABLE 4

| | Toner | Resin comp. | Was (3)–(6) | $A_{VWax}$ (mmKOH/g) | I. D. (HT/HH) final stage | Fog(1) LT/LH | Quality(2) HT/HH | Dot (2a) HT/HH | Fixability Tmin. (°C.) | Anti-offset Tmax (°C.) |
|---|---|---|---|---|---|---|---|---|---|---|
| Ex. 1 | A | I | MA-modified PP-PE | 3.5 | 1.42 | 1.5 | 0.02 | A | 150 | 220 |
| 2 | B | II | MA-modified PP-PE | 7.0 | 1.38 | 2.0 | 0.04 | B | 145 | 200 |
| 3 | C | III | MA-modified PP | 13.0 | 1.43 | 2.4 | 0.06 | B | 165 | 205 |
| 4 | D | IV | MA-modified PP | 7.0 | 1.42 | 1.6 | 0.03 | A | 150 | 225 |
| 5 | E | V | MA-modified PP | 3.5 | 1.38 | 2.5 | 0.04 | B | 160 | 205 |
| 6 | F | VI | MA-modified PP-PE | 7.0 | 1.40 | 2.9 | 0.07 | B | 160 | 200 |
| 7 | G | VII | MA-modified PP | 3.5 | 1.36 | 2.9 | 0.07 | C | 160 | 210 |
| 8 | H | I | MA-modified PP-PE | 1.5 | 1.40 | 1.9 | 0.08 | B | 155 | 220 |
| 9 | I | I | MA-modified PP-PE | 11.0 | 1.38 | 2.9 | 0.08 | B | 145 | 205 |
| Comp. Ex. 1 | a | i | MA-modified PP | 7.0 | 1.31 | 3.5 | 0.17 | C | 170 | 190 |
| 2 | b | ii | MA-modified PP | 7.0 | 1.35 | 4.0 | 0.13 | C | 180 | 190 |
| 3 | c | VII | PE | 0 | 1.30 | 3.8 | 0.15 | C | 180 | 210 |

(1) Fog (both sides) on 4000th sheets in a low temperature/low humidity environment.
(2) Image density uniformity in a high temperature/high humidity environment.
(2a) Dot reproducibility in a high temperature/high humidity environment.
(3)–(6) Same as in Table 2.

EXAMPLE 10

| | | |
|---|---|---|
| Resin composition (I) | 100 | wt.parts |
| Magnetic iron oxide (Dav. = 0.2 μm) | 100 | " |
| Propylene/ethylene (92/8) copolymer wax modified with maleic anhydride (A.V. = 3.5; Mw = 9000) | 4 | " |

-continued

| | | |
|---|---|---|
| Negative charge controlling agent (the same as in Example 1) | 2 | " |

The above ingredients were melt-kneaded through a twin-screw extruder heated at 140° C. The kneaded product was cooled, coarsely crushed by a hammer mill and finely pulverized by a jet mill. The pulverized product was classified by a fixed wall pneumatic classifier to classified powder, which was then subjected to classification by means of a multi-division classifier utilizing the Coanda effect ("Elbow Jet" classifier, available from Nittetsu Kogyo K.K.) to strictly remove ultra-fine powder and coarse powder simultaneously to obtain a negatively chargeable magnetic toner having a weight-average particle size ($D_4$) of 5.7 μm. The thus-obtained toner showed physical properties shown in Tables 6 and 7.

100 wt. parts of the above-prepared magnetic toner was blended with 1.5 wt. parts of hydrophobic silica fine powder ($S_{BET}$=160 $m^2/g$, prepared by successive treatments with dimethyldichlorosilane, hexamethyldisilazane and dimethylsilicone oil in this order) and 0.08 wt. part of styrene-acrylate copolymer fine particles (Dav.=0.05 μm, prepared by soap-free polymerization) by means of a Henschel mixer to obtain a magnetic toner (Toner A-2).

The particle size distribution of Toner A-2 was measured by a Coulter Multisizer (available from Coulter Electronics Inc.), and the data was converted into data for 16 channels (shown in Table 5 below) whereby a particle size distribution as shown in Table 5 was determined. As a result, Toner A-2 showed a weight-average particle size ($D_4$) of 5.71 μm, 5.6% by number of particles of at most 2.52 μm (N (≧2.52 μm) %), 17.5% by number of at most 3.17 μm (N (≦3.17 μm) %) and 69.8% by number of particles of at most 5.04 μm (N (≦5.04 μm) %). Further, Toner A-2 showed a void ratio (obtained as (true density-tap density)/true density) of 0.55.

TABLE 5

| | | Distribution | | | |
|---|---|---|---|---|---|
| | | Number-basis | | Volume-basis | |
| Size (μm) | Number (–) | fractional (%) | cumulation (%) | fractional (%) | cumulation (%) |
| 1.59–2.00 | 0 | 0 | 0 | 0 | 0 |
| 2.00–2.52 | 2811 | 5.6 | 5.6 | 0.6 | 0.6 |
| 2.52–3.17 | 5837 | 11.9 | 17.5 | 2.5 | 3.1 |
| 3.17–4.00 | 11632 | 23.3 | 40.8 | 9.8 | 12.9 |
| 4.00–5.04 | 14496 | 29.0 | 69.8 | 23.6 | 36.5 |
| 5.04–6.35 | 10661 | 21.3 | 91.1 | 33.6 | 70.1 |
| 6.35–8.00 | 3890 | 7.8 | 98.9 | 23.4 | 93.6 |
| 8.00–10.08 | 552 | 1.1 | 100 | 6.0 | 99.6 |
| 10.08–12.70 | 12 | 0 | 100 | 0.2 | 99.8 |
| 12.70–16.00 | 3 | 0 | 100 | 0.2 | 100 |
| 16.00–20.20 | 0 | 0 | 100 | 0 | 100 |
| 20.20–25.40 | 0 | 0 | 100 | 0 | 100 |
| 25.40–32.00 | 0 | 0 | 100 | 0 | 100 |
| 32.00–40.30 | 0 | 0 | 100 | 0 | 100 |
| 40.30–50.80 | 0 | 0 | 100 | 0 | 100 |
| 50.80–64.00 | 0 | 0 | 100 | 0 | 100 |

EXAMPLES 11–18

Comparative Examples 5–8

Negatively chargeable magnetic toners (Toners B-2 to I-2 and Toners (a-2) to (d-2)) were prepared in similar manners as in Example 10 except for using Resin compositions (II) to (VII) and (i) to (ii) and using waxes of specified species and specified acid values shown in Table 6. The other particulars and physical properties of the toners are also shown in Tables 6 and 7.

Comparative Example 9

A magnetic toner (Toner (e-2)) was prepared in the same manner as in Comparative Example 5 except for changing the pulverization and classification conditions for toner production.

TABLE 6

| | | Properties of toners | | | | | | | | | | |
|---|---|---|---|---|---|---|---|---|---|---|---|---|
| | | GPC M. W. distribution | | | | | | | | | Magnetic toner | |
| | | (1) Low | (2) High | | | | | | | | | |
| Example | Toner | M. W.-side peak value LMp | M. W.-side peak value HMp ($\times 10^4$) | Min. ($\times 10^4$) | A ($\geqq 10^6$) (%) | $THF_{ins}$ (wt. %) | Resin comp. | Wax (3)–(6) | $A_{Vwax}$ (mgKOH/g) | Mw of wax | $D_4$ (μm) | Void ratio |
| Ex. 10 | A-2 | 8100 | 67 | 6 | 5.1 | 0.9 | I | MA-modified PP-PE | 3.5 | 9000 | 5.71 | 0.55 |
| 11 | B-2 | 3600 | 62 | 4.5 | 9.2 | 1.4 | II | MA-modified PP-PE | 7.0 | 10000 | 5.69 | 0.55 |
| 12 | C-2 | 26000 | 68 | 9 | 3.0 | 0.4 | III | MA-modified PP | 13.0 | 13000 | 5.43 | 0.56 |
| 13 | D-2 | 8100 | 42 | 5 | 2.0 | 0.3 | IV | MA-modified PP | 7.0 | 12000 | 5.73 | 0.55 |
| 14 | E-2 | 8100 | 27 | 3 | 9.8 | 0.1 | V | MA-modified PP | 3.5 | 12000 | 6.20 | 0.53 |
| 15 | F-2 | 8200 | 67 | 6 | 5.0 | 0.9 | VI | MA-modified PP-PE | 7.0 | 10000 | 6.41 | 0.50 |
| 16 | G-2 | 8100 | 69 | 6 | 5.2 | 1.1 | VII | MA-modified PP | 3.5 | 12000 | 5.97 | 0.54 |
| 17 | H-2 | 8100 | 67 | 6 | 5.1 | 0.9 | I | MA-modified PP-PE | 1.5 | 9000 | 6.37 | 0.51 |
| 18 | I-2 | 8100 | 67 | 6 | 5.1 | 0.9 | I | MA-modified PP-PE | 11.0 | 10000 | 6.03 | 0.54 |
| Ex. 5 | a-2 | 8200 | 67 | 6 | 5.2 | 0.8 | i | MA-modified PP | 7.0 | 12000 | 6.02 | 0.54 |
| 6 | b-2 | 32000 | 80 | 14 | 10.3 | 3.3 | ii | MA-modified PP | 7.0 | 12000 | 6.40 | 0.50 |
| 7 | c-2 | 8100 | 69 | 6 | 5.2 | 1.1 | VI | PE | 0 | 13000 | 5.66 | 0.55 |
| 8 | d-2 | 8200 | 67 | 6 | 5.2 | 0.8 | i | AA-modified PP | 15.0 | 12000 | 6.30 | 0.51 |
| 9 | e-2 | 8200 | 67 | 6 | 5.2 | 0.8 | i | MA-modified PP-PE | 7.0 | 13000 | 7.53 | 0.38 |

(1)–(6): Same as in Table 2.

TABLE 7

Properties of polymer components in toners

| Toner | $A_{VL}$ (mgKOH/g) | $A_{VH}$ (mgKOH/g) | $A_{VL} - A_{VH}$ | $A_{VL} \times W_L/W_L + W_H$ | $A_{VH} \times W_H/W_L + W_H$ | $1/W_L + W_H$ | $(A_{VL}W_L + A_{VH} + W_H)$ | $A_V/TA_V$ | $T_{gL}$ (°C.) | $T_{gH}$ (°C.) |
|---|---|---|---|---|---|---|---|---|---|---|
| A-2 | 23.0 | 7.0 | 16.0 | 17.3 | 1.8 | 19.0 | | 0.44 | 62 | 62 |
| B-2 | 21.0 | 7.0 | 14.0 | 10.5 | 3.5 | 14.0 | | 0.58 | 64 | 62 |
| C-2 | 32.5 | 7.0 | 25.5 | 29.3 | 0.7 | 30.0 | | 0.50 | 62 | 62 |
| D-2 | 23.0 | 0.7 | 22.3 | 16.1 | 0.2 | 16.3 | | 0.53 | 62 | 61 |
| E-2 | 23.0 | 3.5 | 19.5 | 11.5 | 1.8 | 13.3 | | 0.63 | 62 | 64 |
| F-2 | 16.0 | 7.0 | 9.0 | 12.0 | 1.8 | 13.8 | | 0.49 | 62 | 62 |
| G-2 | 24.8 | 23.0 | 1.8 | 18.6 | 5.75 | 24.35 | | 0.61 | 62 | 61 |
| H-2 | 23.0 | 7.0 | 16.0 | 17.3 | 1.8 | 19.0 | | 0.44 | 62 | 62 |
| I-2 | 23.0 | 7.0 | 16.0 | 17.3 | 1.8 | 19.0 | | 0.44 | 62 | 62 |
| a-2 | 0.7 | 7.0 | −6.3 | 0.5 | 1.8 | 2.3 | | 0.82 | 62 | 62 |
| b-2 | 21.0 | 7.0 | 14.0 | 13.7 | 2.5 | 16.1 | | 0.65 | 63 | 62 |
| c-2 | 24.8 | 23.0 | 1.8 | 18.6 | 5.75 | 24.35 | | 0.61 | 62 | 61 |
| d-2 | 0.7 | 7.0 | −6.3 | 0.5 | 1.8 | 2.3 | | 0.82 | 62 | 62 |
| e-2 | 0.7 | 7.0 | −6.3 | 0.5 | 1.8 | 2.3 | | 0.82 | 62 | 62 |

[Image Forming Test]

Each magnetic toner shown in Tables 6 and 7 was charged in a process-cartridge and evaluated by an image forming test using an apparatus and conditions similar to those used in Example 1. The test was performed in an intermittent printing mode of 2 sheets/20 sec. in a high temperature/high humidity environment (HT/HH=32.5° C./85% RH) and in a low temperature/low humidity environment (LT/LH=10° C./15% RH). The resultant images were evaluated with respect to the following items, and the results are inclusively shown in Table 8 appearing hereinafter.

1) Image Density

2) Fog

Evaluated in the same manner as in Example 1.

3) Dot Reproducibility

A discrete dot pattern was printed out in an environment (NT/NH) of 23° C. and 60% RH, and the reproducibility of one dot was evaluated by microscopic observation according to the following standards:

A: Dot was faithfully reproduced.

B: Dot was faithfully reproduced but accompanied with some scattering.

C: Dot image was somewhat disordered.

D: Dot image was accompanied with much disorder, and the reproducibility was poor.

4) Sleeve Ghost (SG)

Figure 8:
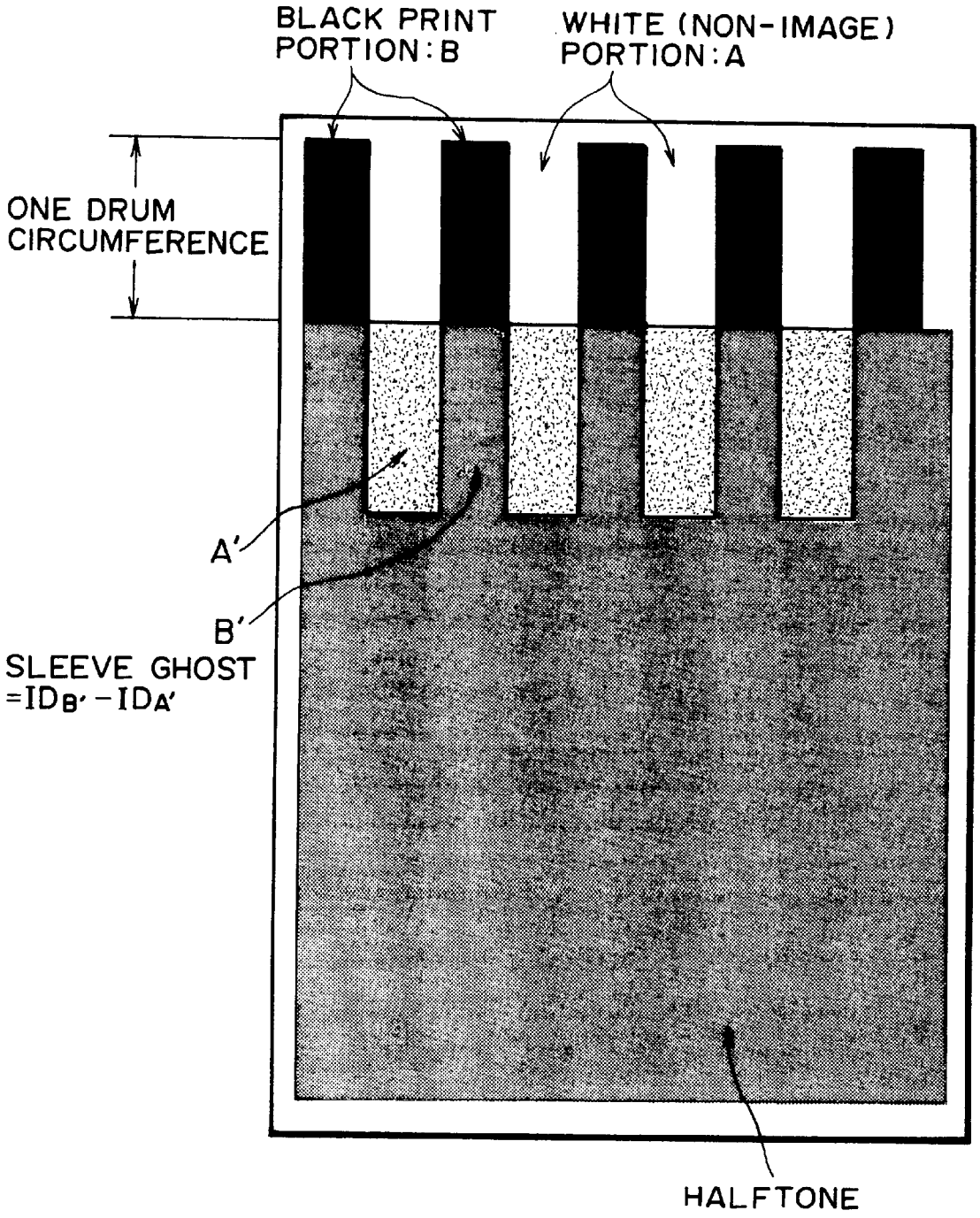
FIG. 8 is an illustration of an image pattern used for sleeve ghost evaluation.

Sleeve ghost was evaluated as follows. In an environment of 15° C./10% RH, a solid white image was continuously formed on 10 sheets and, immediately thereafter, a subsequent sheet was printed with an image pattern as shown in FIG. 8 having alternating stripes of solid black print portion (B) and solid white print portion (W) for a length of one photosensitive drum circumference, followed by a whole-area uniform halftone image portion. Then, the image density ($ID_{B'}$) at a halftone image portion B' subsequent to the solid black stripe portion (B) and the image density ($ID_{A'}$) at a halftone image portion A' subsequent to the solid white stripe portion (A) were measured. The sleeve ghost (SG) was evaluated in terms of an image density difference ($ID_{B'}-ID_{A'}$).

[Fixability, Anti-offset Characteristic Test]

Evaluated in the same manner as in Example 1.

TABLE 8

Evaluation results

| Example | Toner No. | Resin comp. | Was (3)–(6) MA-modified PP-PE | $A_{VWax}$ (mgKOH/g) | Mw of Wax | I. D. (HT/HH) at 5500-th sheets | I. D. (HT/HH) at 10000-th sheets | Fog(1) LT/LH | Dot(2a) NT/NH | Fixability Tmin. (°C.) | Anti-offset Tmax. (°C.) |
|---|---|---|---|---|---|---|---|---|---|---|---|
| Ex. 10 | A-2 | I | MA-modified PP-PE | 3.5 | 9000 | 1.40 | 1.43 | 1.9 | A | 150 | 220 |
| 11 | B-2 | II | MA-modified PP-PE | 7.0 | 10000 | 1.36 | 1.39 | 2.3 | B | 145 | 200 |
| 12 | C-2 | III | MA-modified PP | 13.0 | 13000 | 1.41 | 1.42 | 2.7 | A | 165 | 205 |
| 13 | D-2 | IV | MA-modified PP | 7.0 | 12000 | 1.40 | 1.43 | 1.9 | A | 150 | 225 |
| 14 | E-2 | V | MA-modified PP | 3.5 | 12000 | 1.36 | 1.39 | 2.8 | B | 160 | 205 |
| 15 | F-2 | VI | MA-modified PP-PE | 7.0 | 10000 | 1.38 | 1.41 | 3.2 | C | 160 | 200 |
| 16 | G-2 | VII | MA-modified PP | 3.5 | 12000 | 1.34 | 1.37 | 3.3 | C | 160 | 210 |
| 17 | H-2 | I | MA-modified PP-PE | 1.5 | 9000 | 1.38 | 1.41 | 2.2 | B | 155 | 220 |
| 18 | I-2 | I | MA-modified PP-PE | 11.0 | 10000 | 1.36 | 1.39 | 3.2 | B | 145 | 205 |
| Comp. Ex. 5 | a-2 | i | MA-modified PP | 3.5 | 12000 | 1.29 | 1.31 | 3.8 | C | 170 | 190 |
| 6 | b-2 | ii | MA-modified PP | 7.0 | 12000 | 1.33 | 1.35 | 4.3 | C | 180 | 190 |
| 7 | c-2 | VII | PE | 0 | 13000 | 1.28 | 1.30 | 4.1 | C | 180 | 210 |

TABLE 8-continued

| Example | Toner No. | Resin comp. | Was (3)–(6) MA-modified PP-PE | $A_{VWax}$ (mgKOH/g) | Mw of Wax | Evaluation results: I. D. (HT/HH) at 5500-th sheets | I. D. (HT/HH) at 10000-th sheets | Fog(1) LT/LH | Dot(2a) NT/NH | Fixability Tmin. (°C.) | Anti-offset Tmax. (°C.) |
|---|---|---|---|---|---|---|---|---|---|---|---|
| 8* | d-2 | i | AA-modified PE | 15.0 | 12000 | 1.27 | 1.27 | 4.5 | C | 160 | 185 |
| 9 | e-2 | i | MA-modified PP | 3.5 | 17000 | 1.28 | 1.30 | 3.6 | D | 170 | 190 |

(1)–(6): Same as in Table 4.
(2a): Dot reproducibility in a normal temperature/normal humidity environment.
*: Sleeve ghost was observed when the toner of Comparative Example 8 was used.

EXAMPLE 19

| | | |
|---|---|---|
| Resin composition (I) | 100 | wt.parts |
| Magnetic iron oxide (Dav. = 0.2 μm) | 100 | " |
| Propylene/ethylene (92/8) copolymer wax graft-copolymerized with maleic anhydride (Mw = 9000, A.V. = 3.5; Tmp (melting point) = 123° C.) | 4 | " |
| Polypropylene (Mw = 20,000) | 4 | " |
| Negative charge controlling agent of (the same as in Example 1) | 2 | " |

The above ingredients were melt-kneaded through a twin-screw extruder heated at 140° C. The kneaded product was cooled, coarsely crushed by a hammer mill and finely pulverized by a jet mill. The pulverized product was classified by a fixed wall pneumatic classifier to classified powder, which was then subjected to classification by means of a multi-division classifier utilizing the Coanda effect ("Elbow Jet" classifier, available from Nittetsu Kogyo K.K.) to strictly remove ultra-fine powder and coarse powder simultaneously to obtain a negatively chargeable magnetic toner having a weight-average particle size ($D_4$) of 6.1 μm.

The thus-obtained toner showed physical properties shown in Tables 10 and 11.

100 wt. parts of the above-prepared magnetic toner was blended with 1.2 wt. parts of hydrophobic silica fine powder (($S_{BET}$)=160 $m^2/g$, prepared by successive treatments with dimethyldichlorosilane, hexamethyldisilazane and dimethylsilicone oil in this order) and 0.08 wt. part of styrene-acrylate copolymer fine particles (Dav.=0.05 μm, prepared by soap-free polymerization) by means of a Henschel mixer to obtain a magnetic toner (Toner A-3).

EXAMPLES 20–29

Comparative Examples 10–14

Negatively chargeable magnetic toners (Toners B-3 to K-3 and Toners (a-3) to (e-3)) were prepared in similar manners as in Example 19 except for using Resin compositions (II) to (VII) and (i) to (ii) and using waxes of specified species and specified acid values shown in Table 9. The other particulars and physical properties of the toners are also shown in Tables 10 and 11.

TABLE 9

| | Wax A: *Species (3)–(6) | Wax A: Mw (×10⁴) | Wax A: $A_v$ (mgKOH/g) | Wax B: Series (4), (5) | Wax B: Mw (×10⁴) | Wax B: $A_v$ (mgKOH/g) |
|---|---|---|---|---|---|---|
| Ex. 19 | MA-modified PP-PE | 0.9 | 3.5 | PP | 2.0 | 0 |
| 20 | MA-modified PP-PE | 1.0 | 7.0 | PP | 2.0 | 0 |
| 21 | MA-modified PP | 1.3 | 13.0 | PP | 2.0 | 0 |
| 22 | MA-modified PP | 1.2 | 7.0 | PP | 2.0 | 0 |
| 23 | MA-modified PP | 1.2 | 3.5 | PP | 2.0 | 0 |
| 24 | MA-modified PP-PE | 1.0 | 7.0 | PP | 2.0 | 0 |
| 25 | MA-modified PP | 1.2 | 3.5 | PP | 2.0 | 0 |
| 26 | MA-modified PP-PE | 0.9 | 1.5 | PP | 2.0 | 0 |
| 27 | MA-modified PP-PE | 1.0 | 11.0 | PP | 2.0 | 0 |
| 28 | MA-modified PP-PE | 0.9 | 3.5 | PP | 3.6 | 0 |
| 29 | MA-modified PP-PE | 0.9 | 3.5 | PP | 1.1 | 0 |
| Comp.Ex. 10 | MA-modified PP | 1.2 | 7.0 | PP | 2.0 | 0 |
| 11 | MA-modified PP | 1.2 | 7.0 | PP | 2.0 | 0 |
| 12 | PE | 1.3 | 0.0 | — | — | — |
| 13 | AA-modified PE | 1.2 | 18.0 | PP | 0.8 | 0 |
| 14 | AA-modified PP | 1.7 | 7.0 | PE | 5.0 | 0 |

*(3)–(6): Same as in Table 2.

TABLE 10

| | Toner | GPC M. W. distribution (1) Low M. W.-side peak value LMp | (2) High M. W.-side peak value HMp ($\times 10^4$) | Min ($\times 10^4$) | A ($\geqq 10^6$) (%) | $THF_{ins}$ (wt. %) | Resin comp. |
|---|---|---|---|---|---|---|---|
| Ex. 19 | A-3 | 8100 | 67 | 6 | 5.1 | 0.9 | I |
| 20 | B-3 | 3600 | 62 | 4.5 | 9.2 | 1.4 | II |
| 21 | C-3 | 26000 | 68 | 9 | 3.0 | 0.4 | III |
| 22 | D-3 | 8100 | 42 | 5 | 2.0 | 0.3 | IV |
| 23 | E-3 | 8100 | 27 | 3 | 9.8 | 0.1 | V |
| 24 | F-3 | 8200 | 67 | 6 | 5.0 | 0.9 | VI |
| 25 | G-3 | 8100 | 69 | 6 | 5.2 | 1.1 | VII |
| 26 | H-3 | 8100 | 67 | 6 | 5.1 | 0.9 | I |
| 27 | I-3 | 8100 | 67 | 6 | 5.1 | 0.9 | I |
| 28 | J-3 | 8100 | 67 | 6 | 5.1 | 0.9 | I |
| 29 | K-3 | 8100 | 67 | 6 | 5.1 | 0.9 | I |
| Comp.Ex. 10 | a-3 | 8200 | 67 | 6 | 5.2 | 0.8 | i |
| 11 | b-3 | 32000 | 80 | 14 | 10.3 | 3.3 | ii |
| 12 | c-3 | 8100 | 69 | 6 | 5.2 | 1.1 | VII |
| 13 | d-3 | 8100 | 69 | 6 | 5.2 | 1.1 | VI |
| 14 | e-3 | 8100 | 69 | 6 | 5.2 | 1.1 | i |

(1) & (2): Same as in Table 2.

TABLE 11

Properties of polymer components in toners

| Toner | $A_{VL}$ (mgKOH/g) | $A_{VH}$ (mgKOH/g) | $A_{VL} - A_{VH}$ | $A_{VL} \times W_L/W_L + W_H$ | $A_{VH} \times W_H/W_L + W_H$ | $1/W_L + W_H$ | $(A_{VL}W_L + A_{VH} + W_H)$ | $A_V/TA_V$ | $T_{gL}$ (°C.) | $T_{gH}$ (°C.) |
|---|---|---|---|---|---|---|---|---|---|---|
| A-3 | 23.0 | 7.0 | 16.0 | 17.3 | 1.8 | | 19.0 | 0.44 | 62 | 62 |
| B-3 | 21.0 | 7.0 | 14.0 | 10.5 | 3.5 | | 14.0 | 0.58 | 64 | 62 |
| C-3 | 32.5 | 7.0 | 25.5 | 29.3 | 0.7 | | 30.0 | 0.50 | 62 | 62 |
| D-3 | 23.0 | 0.7 | 22.3 | 16.1 | 0.2 | | 16.3 | 0.53 | 62 | 61 |
| E-3 | 23.0 | 3.5 | 19.5 | 11.5 | 1.8 | | 13.3 | 0.63 | 62 | 64 |
| F-3 | 16.0 | 7.0 | 9.0 | 12.0 | 1.8 | | 13.8 | 0.49 | 62 | 62 |
| C-3 | 24.8 | 23.0 | 1.8 | 18.6 | 5.75 | | 24.35 | 0.61 | 62 | 61 |
| H-3 | 23.0 | 7.0 | 16.0 | 17.3 | 1.8 | | 19.0 | 0.44 | 62 | 62 |
| I-3 | 23.0 | 7.0 | 16.0 | 17.3 | 1.8 | | 19.0 | 0.44 | 62 | 62 |
| a-3 | 0.7 | 7.0 | −6.3 | 0.5 | 1.8 | | 2.3 | 0.82 | 62 | 62 |
| b-3 | 21.0 | 7.0 | 14.0 | 17.9 | 1.1 | | 18.9 | 0.65 | 63 | 62 |
| c-3 | 24.8 | 23.0 | 1.8 | 18.6 | 5.75 | | 24.35 | 0.61 | 62 | 61 |
| d-3 | 16.0 | 7.0 | 9.0 | 12.0 | 1.8 | | 13.3 | 0.63 | 62 | 64 |
| e-3 | 0.7 | 7.0 | −6.3 | 0.5 | 1.8 | | 2.3 | 0.82 | 62 | 62 |

[Image Forming Test]

[Fixability, Anti-offset Characteristic Test]

Each magnetic toner shown in Tables 9 and 10 was charged in a process cartridge and evaluated by using an apparatus and conditions similar to those in Example 1.

The tests were performed in an intermittent printing mode of 2 sheets/20 sec. in a high temperature/high humidity environment (HT/HH=32.5° C./85% RH) and in a low temperature/low humidity environment (LT/LH=10° C./15% RH). The resultant images were evaluated with respect to the same items, as in Example 1 and the results are inclusively shown in Table 12 appearing hereinafter.

TABLE 12

Evaluation results

| Example | Toner No. | Magnetic toner $D_4$ ($\mu$m) | N ($\leqq 3.17$ $\mu$m) (% by number) | Void ratio | I. D. (HT/HH) final stage | Fog(1) LT/LH | Quality(2) HT/HH | Dot(2a) HT/HH | Fixability Tmin. (°C.) | Anti-offset Tmax. (°C.) |
|---|---|---|---|---|---|---|---|---|---|---|
| Ex. 19 | A-3 | 6.10 | 18.5 | 0.55 | 1.42 | 1.5 | 0.02 | A | 150 | 240 |
| 20 | B-3 | 5.87 | 17.9 | 0.53 | 1.38 | 2.0 | 0.04 | B | 145 | 220 |
| 21 | C-3 | 6.04 | 17.6 | 0.53 | 1.43 | 2.4 | 0.06 | B | 165 | 225 |
| 22 | D-3 | 5.82 | 19.9 | 0.55 | 1.42 | 1.6 | 0.03 | A | 150 | 245 |

TABLE 12-continued

| | | Magnetic toner | | | Evaluation results | | | | | |
|---|---|---|---|---|---|---|---|---|---|---|
| Example | Toner No. | $D_4$ (μm) | N (≦3.17 μm) (% by number) | Void ratio | I. D. (HT/HH) final stage | Fog(1) LT/LH | Quality(2) HT/HH | Dot(2a) HT/HH | Fixability Tmin. (°C.) | Anti-offset Tmax. (°C.) |
| 23 | E-3 | 6.07 | 18.2 | 0.54 | 1.38 | 2.5 | 0.04 | B | 160 | 225 |
| 24 | F-3 | 6.04 | 18.6 | 0.53 | 1.40 | 2.9 | 0.07 | B | 160 | 220 |
| 25 | G-3 | 5.92 | 19.3 | 0.54 | 1.36 | 2.9 | 0.07 | C | 160 | 230 |
| 26 | H-3 | 5.86 | 19.6 | 0.54 | 1.40 | 1.9 | 0.08 | B | 155 | 240 |
| 27 | I-3 | 6.11 | 18.4 | 0.53 | 1.38 | 2.9 | 0.08 | B | 145 | 225 |
| 28 | J-3 | 6.12 | 17.8 | 0.55 | 1.37 | 2.5 | 0.08 | B | 170 | 245 |
| 29 | K-3 | 5.96 | 19.2 | 0.53 | 1.40 | 2.8 | 0.08 | B | 145 | 210 |
| Comp. Ex. 10 | a-3 | 6.05 | 18.9 | 0.55 | 1.31 | 3.5 | 0.17 | C | 170 | 200 |
| 11 | b-3 | 5.99 | 19.4 | 0.55 | 1.35 | 4.0 | 0.13 | C | 180 | 200 |
| 12 | c-3 | 6.01 | 19.3 | 0.54 | 1.30 | 3.8 | 0.15 | C | 180 | 210 |
| 13 | d-3 | 5.86 | 19.5 | 0.54 | 1.27 | 4.5 | 0.26 | D | 160 | 190 |
| 14 | e-3 | 6.13 | 18.3 | 0.55 | 1.32 | 3.0 | 0.20 | C | 200 | 230 |

(1), (2), (2a): Same as in Table 4.

What is claimed is:

1. A toner for developing an electrostatic image, comprising a composition including: polymer components, a colorant, a wax terminally modified with at least one of maleic acid, maleic acid half ester or maleic anhydride and a charge-controlling agent, wherein the polymer components are characterized by (a) containing substantially no THF (tetrahydrofuran)-insoluble content;

(b) containing a THF-soluble content giving a GPC (gel permeation chromatography) chromatogram showing a main peak in a molecular weight region of $3\times10^3$–$3\times10^4$, and a sub-peak or shoulder in a molecular weight region of $1\times10^5$–$3\times10^6$, and (c) including a low-molecular weight polymer component having molecular weights of below $5\times10^4$ on the GPC chromatogram and an acid value $A_{VL}$, and a high-molecular weight polymer component having molecular weights of at least $5\times10^4$ and an acid value $A_{VH}$, satisfying $A_{VL}>A_{VH}$; and the wax has an acid value $A_{VWAX}$ satisfying $$0.5\times A_{VL}>A_{VWAX}>0.05\times A_{VL},$$

$$1.5\text{ mgKOH/g}\leqq A_{VWAX}\leqq 13.0\text{ mgKOH/g}.$$

2. The toner according to claim 1, wherein the wax comprises polypropylene wax terminally modified with at least one species of acidic monomer selected from the group consisting of maleic acid, maleic acid half ester and maleic anhydride.

3. The toner according to claim 1, wherein the wax and the low-molecular weight polymer component respectively contain an acidic component which has originated from at least one species of acid monomer selected from the group consisting of maleic acid, maleic acid half ester and maleic anhydride.

4. The toner according to claim 1, wherein the low molecular weight polymer component has an acid value ($A_{VL}$) of 21–35 mgKOH/g, and the high-molecular weight polymer component has an acid value ($A_{VH}$) of 0.5–11 mgKOH/g.

5. The toner according to claim 1, wherein the low molecular weight polymer component has an acid value ($A_{VL}$) of 21–35 mgKOH/g, and the high-molecular weight polymer component has an acid value ($A_{VH}$) of 0.5–11 mgKOH/g, giving a difference therebetween ($A_{VL}-A_{VH}$) satisfying:

$$10\leqq(A_{VL}-A_{HL})\leqq 27.$$

6. The toner according to claim 1, wherein the polymer components contain a THF-soluble content giving a GPC chromatogram showing a minimum in a molecular weight region of from $3\times10^4$ to below $1\times10^5$.

7. The toner according to claim 1, wherein the composition has a glass transition temperature (Tg) of 50–70° C., and the low- and high-molecular weight polymer components have glass transition temperatures $Tg_L$ and $Tg_H$, respectively, satisfying:

$$Tg_L\geqq Tg_H-5.$$

8. The toner according to claim 7, wherein Tg is 55–65° C., and $Tg_L\geqq Tg_H$.

9. The toner according to claim 1, wherein the low- and high-molecular weight polymer components are contained at $W_L$ wt. % and $W_H$ wt. %, respectively, in the polymer components of the composition so as to satisfy the following conditions in relation to their acid values $A_{VL}$ (mgKOH/g) and $A_{VH}$ (mgKOH/g), respectively:

$$W_L:W_H=50:50\text{ to }90:10,$$

$$A_{VL}\times W_L/(W_L+W_H)\geqq A_{VH}\times W_H\times 4/(W_L+W_H),$$

and $$11\leqq(A_{VL}W_L+A_{VH}W_H)/(W_L+W_H)\leqq 30.$$

10. The toner according to claim 1, wherein the low- and high-molecular weight polymer components respectively contain at least 65 wt. % of polymerized styrene units.

11. The toner according to claim 1, wherein the high-molecular weight polymer component comprises a polymer polymerized by using a polyfunctional polymerization initiator.

12. The toner according to claim 1, wherein the high-molecular weight polymer component comprises a polymer polymerized by using a polyfunctional polymerization initiator and a monofunctional polymerization initiator in combination.

13. The toner according to claim 1, wherein the polymer components provide a GPC chromatogram showing an areal percentage of at most 10% in a molecular weight region of at least $10^6$.

14. The toner according to claim 1, wherein the charge-controlling agent comprises a metal-containing organic compound represented by the following formula I:

I

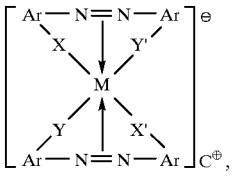

wherein M denotes a coordination center metal having a coordination number of 6, selected from the group consisting of Cr, Co, Ni, Mn and Fe; Ar denotes an aryl group selected from the group consisting of phenyl and naphthyl, capable of having a substituent selected from the group consisting of nitro, halogen, carboxyl, anilide, and alkyl and alkoxy having 1–8 carbon atoms; X, X', Y and Y' independently denote —O—, —CO—, —NH—, or —NR— (wherein R denotes an alkyl having 1–4 carbon atoms); and $C^{\oplus}$ denotes hydrogen, sodium, potassium, ammonium or aliphatic ammonium.

15. The toner according to claim 14, wherein said metal-containing organic compound is a compound represented by the following formula:

[III]

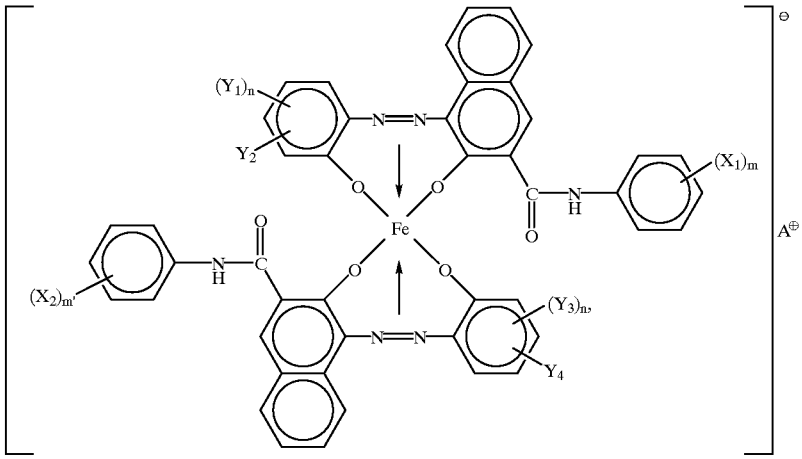

wherein $X_1$ and $X_2$ independently denote hydrogen, lower alkyl, lower alkoxy, nitro or halogen;

m and m' independently denote an integer of 1–3;

$Y_1$ and $Y_3$ independently denote hydrogen, $C_1$–$C_{18}$ alkyl, $C_2$–$C_{18}$ alkenyl, sulfonamide, mesyl, sulfonic acid, carboxy ester, hydroxy, $C_1$–$C_{18}$ alkoxy, acetylamino, benzoyl, amino or halogen;

n and n' independently denote an integer of 1–3;

$Y_2$ and $Y_4$ independently denote hydrogen or nitro; and $A^{\oplus}$ denotes $H^+$, $Na^+$, $K^+$, $NH_4^+$ or a mixture of these ions.

16. The toner according to claim 14, wherein said metal-containing organic compound is a compound represented by the following formula:

[IV]

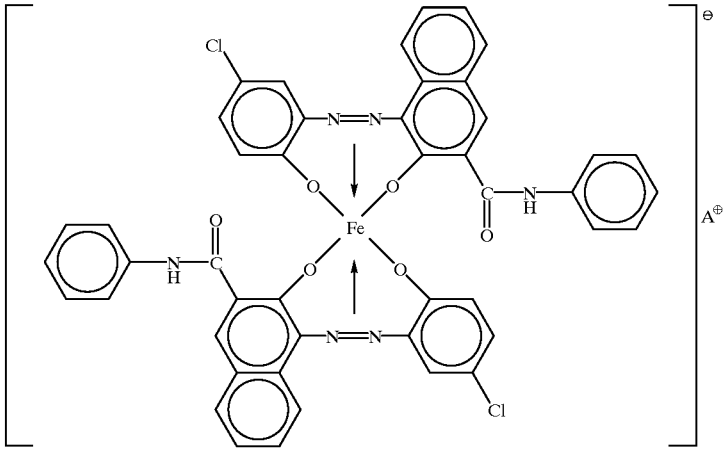

wherein $A^{\oplus}$ denotes $H^+$, $Na^+$, $K^+$, $NH_4^+$ or a mixture of these ions.

17. The toner according to claim 1, wherein the charge-controlling agent comprises a metal-containing organic compound represented by the following formula II:

II

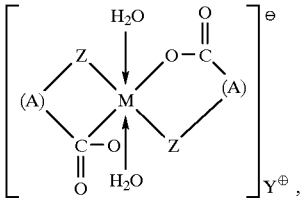

wherein M denotes a coordination center metal having a coordination number of 6, selected from the group consisting of Cr, Co, Ni, Mn and Fe; A denotes an arylene selected from the group consisting of

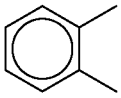

(capable of having an alkyl substitutent),

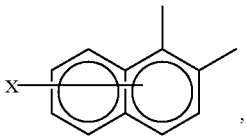

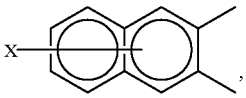

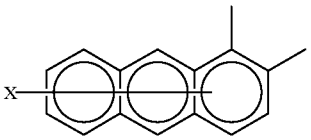

-continued

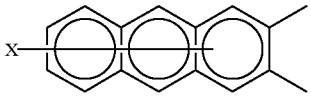

(X denotes hydrogen alkyl, halogen, or (nitro),

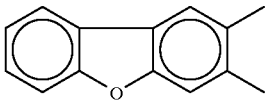

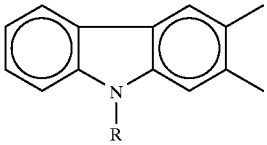

and

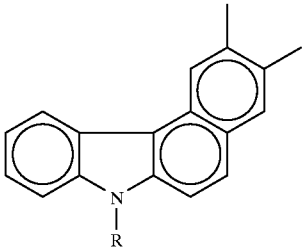

(R denotes hydrogen, $C_1$–$C_{18}$ alkyl or $C_1$–$C_{18}$ alkenyl); $Y^{\oplus}$ denotes a counter ion selected from the group consisting of hydrogen, sodium, potassium, ammonium and aliphatic ammonium; and Z denotes —O— or —CO.O—.

18. The toner according to claim 1, wherein the toner is in the form of particles having a particle size distribution including a weight-average particle size ($D_4$) of X $\mu$m and Y % by number of toner particles having a particle size of at most 3.17 $\mu$m satisfying the following conditions (1) and (2):

$$-5X+35 \leqq Y \leqq -25X+180 \quad (1)$$

$$3.5 \leqq X \leqq 6.5 \quad (2).$$

19. The toner according to claim 1, wherein the wax comprises both a polyolefin (A) terminally modified with said at least one of maleic acid, maleic acid half ester, or maleic anhydride and a polyolefin (B);

the modified polyolefin (A) has a weight-average molecular weight ($Mw_{WaxA}$) of $8.0\times10^3$–$1.4\times10^4$, and the polyolefin (B) has a weight-average molecular weight ($MW_{WaxB}$) of $1.0\times10^4$–$4.0\times10^4$.

20. The toner according to claim 19, wherein the weight-average molecular weight ($Mw_{WaxB}$) of the polyolefin (B) is $1.5\times10^4$–$2.5\times10^4$.

21. The toner according to claim 19, wherein the modified polyolefin (A) comprises polypropylene wax terminally modified with at least one species of acidic monomer selected from the group consisting of maleic acid, maleic acid half ester and maleic anhydride.

22. The toner according to claim 19, wherein the polyolefin (B) comprises polypropylene wax.

23. The toner according to claim 19, wherein the modified polyolefin (A) and the low-molecular weight polymer component respectively contain an acid component which has originated from at least one species of acidic monomer selected from the group consisting of maleic acid, maleic acid half ester and maleic anhydride.

24. The toner according to claim 19, wherein the low molecular weight polymer component has an acid value ($A_{VL}$) of 21–35 mgKOH/g, and the high-molecular weight polymer component has an acid value ($A_{VH}$) of 0.5–11 mgKOH/g.

25. The toner according to claim 24, wherein the low molecular weight polymer component has an acid value ($A_{VL}$) of 21–35 mgKOH/g, and the high-molecular weight polymer component has an acid value ($A_{VH}$) of 0.5–11 mgKOH/g, giving a difference therebetween ($A_{VL}-A_{VH}$) satisfying:

$$10\leqq(A_{VL}-A_{HL})\leqq27.$$

26. The toner according to claim 19, wherein the polymer components contain a THF-soluble content giving a GPC chromatogram showing a minimum in a molecular weight region of from $3\times10^4$ to below $1\times10^5$.

27. The toner according to claim 19, wherein the composition has a glass transition temperature (Tg) of 50–70° C., and the low- and high-molecular weight polymer components have glass transition temperatures $Tg_L$ and $Tg_H$, respectively, satisfying:

$$Tg_L\geqq Tg_H-5.$$

28. The toner according to claim 27, wherein Tg is 55–65° C., and $Tg_L\geqq Tg_H$.

29. The toner according to claim 19, wherein the low- and high-molecular weight polymer components are contained at $W_L$ wt. % and $W_H$ wt. %, respectively, in the polymer components of the composition so as to satisfy the following conditions in relation to their acid values $A_{VL}$ (mgKOH/g) and $A_{VH}$ (mgKOH/g), respectively:

$$W_L:W_H=50:50 \text{ to } 90:10,$$

$$A_{VL}\times W_L/(W_L+W_H)\geqq A_{VH}\times W_H\times4/(W_L+W_H),$$

and $$11\leqq(A_{VL}W_L+A_{VH}W_H)/(W_L+W_H)\leqq30.$$

30. The toner according to claim 19, wherein the low- and high-molecular weight polymer components respectively contain at least 65 wt. % of polymerized styrene units.

31. The toner according to claim 19, wherein the high-molecular weight polymer component comprises a polymer polymerized by using a polyfunctional polymerization initiator.

32. The toner according to claim 19, wherein the high-molecular weight polymer component comprises a polymer polymerized by using a polyfunctional polymerization initiator and a monofunctional polymerization initiator in combination.

33. The toner according to claim 19, wherein the polymer components provide a GPC chromatogram showing an areal percentage of at most 10% in a molecular weight region of at least $10^6$.

34. An image forming method, comprising: forming an electrostatic image on an electrostatic image-bearing member, and developing the electrostatic image with a toner contained in developing means to form a toner image;

wherein the toner is a toner according to any one of claims 5–23 or 26–33.

35. The toner according to claim 1, wherein the wax comprises polyolefin wax modified to have an acid value of 3.5 to 13.0 mgKOH/g.

36. An image forming method, comprising: forming an electrostatic image on an electrostatic image-bearing member, and developing the electrostatic image with a toner contained in developing means to form a toner image;

wherein the toner comprises polymer components, a colorant, a wax terminally modified with at least one of maleic acid, maleic acid half ester or maleic anhydride and a charge-controlling agent; the polymer components are characterized by (a) containing substantially no THF (tetrahydrofuran)-insoluble content;

(b) containing a THF-soluble content giving a GPC (gel permeation chromatography) chromatogram showing a main peak in a molecular weight region of $3\times10^3$–$3\times10^4$, and a sub-peak or shoulder in a molecular weight region of $1\times10^5$–$3\times10^6$, and (c) including a low-molecular weight polymer component having molecular weights of below $5\times10^4$ on the GPC chromatogram and an acid value $A_{VL}$, and a high-molecular weight polymer component having molecular weights of at least $5\times10^4$ and an acid value $A_{VH}$ satisfying $A_{VH}\leqq A_{VH}$; and the wax has an acid value $A_{VWAX}$ satisfying $$0.5\times A_{VL}>A_{VWAX}>0.05\times A_{VL}$$

and $$1.5 \text{ mgKOH/g}\leqq A_{VWAX}\leqq13.0 \text{ mg/KOH/g}.$$

37. The method according to claim 36, wherein the toner image is transferred to a transfer-receiving member via or without via an intermediate transfer member, and then the toner image is fixed onto the transfer receiving member under application of heat and pressure by fixing means.

38. The method according to claim 37, wherein the toner image is transferred onto the transfer-receiving member by contact means supplied with a bias voltage.

39. The method according to claim 37, wherein the electrostatic image-bearing member surface is cleaned by cleaning means after the toner image is transferred therefrom.

40. The method according to claim 36, wherein said electrostatic image-bearing member is charged by charging means and then exposed to light to form the electrostatic image thereon.

41. The method according to claim 40, wherein the electrostatic image-bearing member is charged by contact charging means.

* * * * *